US012281842B2

(12) United States Patent
Bickel et al.

(10) Patent No.: US 12,281,842 B2
(45) Date of Patent: Apr. 22, 2025

(54) REFRIGERATION APPLIANCE CABINET

(71) Applicant: FISHER & PAYKEL APPLIANCES LIMITED, Auckland (NZ)

(72) Inventors: Carl Lee Bickel, Auckland (NZ); Richard Wong, Auckland (NZ); Ian Campbell McGill, Auckland (NZ); Kenneth William Foster, Auckland (NZ); Yunchao Hou, Auckland (NZ)

(73) Assignee: FISHER & PAYKEL APPLIANCES LIMITED (NZ)

( * ) Notice: Subject to any disclaimer, the term of this patent is extended or adjusted under 35 U.S.C. 154(b) by 0 days.

(21) Appl. No.: 17/275,492

(22) PCT Filed: Sep. 12, 2019

(86) PCT No.: PCT/NZ2019/050122
§ 371 (c)(1),
(2) Date: Mar. 11, 2021

(87) PCT Pub. No.: WO2020/055273
PCT Pub. Date: Mar. 19, 2020

(65) Prior Publication Data

US 2022/0120492 A1 Apr. 21, 2022

(30) Foreign Application Priority Data

Sep. 12, 2018 (NZ) ..... 746328

(51) Int. Cl.
*F25D 23/06* (2006.01)
*F25D 23/00* (2006.01)

(52) U.S. Cl.
CPC ..... *F25D 23/067* (2013.01); *F25D 23/062* (2013.01); *F25D 23/006* (2013.01); *F25D 2323/06* (2013.01); *F25D 2500/02* (2013.01)

(58) Field of Classification Search
CPC ..... F25D 23/006; F25D 23/06; F25D 23/062; F25D 23/065; F25D 23/067;
(Continued)

(56) References Cited

U.S. PATENT DOCUMENTS 2,180,472 A * 11/1939 Kucher ..... F25D 23/003 165/169
2,338,194 A * 1/1944 Winter ..... F25D 23/062 220/592.09

(Continued)

FOREIGN PATENT DOCUMENTS

CN 201757557 3/2011
CN 104105933 10/2014

(Continued)

OTHER PUBLICATIONS

International Search Report, PCT/NZ2019/050122, Form PCT/ISA/210, dated Dec. 24, 2019.

(Continued)

*Primary Examiner* — Andrew Roersma
(74) *Attorney, Agent, or Firm* — Clark Hill PLC; Timothy M. McCarthy

(57) ABSTRACT

A refrigeration cabinet assembly for a refrigeration appliance (1) comprises a cabinet (20) having five closed faces and an open front face providing access to an interior of the cabinet. A lateral stiffening arrangement (50, 51) is provided within the cabinet to resist bending or bowing of the side walls, particularly when the cabinet includes upper and lower compartments, the upper compartment having a door hinged to the cabinet. The lateral stiffening arrangement reduces door droop. A torsionally stiff structure may also be fixed to one of the five closed faces (23) or a structure (31) could be added to one of the five closed faces (23) so that together with that closed face a torsionally stiff structure results. The torsional stiffness of the assembly is thereby (Continued)

increased beyond that of the cabinet alone so that the insulated cabinet has an improved ability to resist twisting, further reducing door droop.

25 Claims, 10 Drawing Sheets

(58) Field of Classification Search
CPC ..... F25D 2323/00; F25D 2323/06; F25D 2400/04; F25D 2500/02
See application file for complete search history.

(56) References Cited

U.S. PATENT DOCUMENTS

| | | | | | |
|---|---|---|---|---|---|
| 2,347,090 | A * | 4/1944 | Drake | F25D 23/02 | 52/223.6 |
| 2,386,935 | A * | 10/1945 | Dailey | F25D 23/062 | 126/39 B |
| 2,612,661 | A * | 10/1952 | Semple | F25D 23/02 | 52/794.1 |
| 2,725,271 | A * | 11/1955 | Cunningham | F25D 23/062 | 427/427 |
| 2,741,808 | A * | 4/1956 | Rasmussen | F25D 23/02 | 52/127.12 |
| 2,795,015 | A * | 6/1957 | Foley | F25D 23/02 | 52/693 |
| 2,835,405 | A * | 5/1958 | Gilbert | F25D 23/062 | 220/592.06 |
| 2,860,807 | A * | 11/1958 | Morton | F25D 23/065 | 220/592.09 |
| 3,038,769 | A | 6/1962 | Smith | | |
| 3,948,410 | A * | 4/1976 | Anderson | F25D 23/062 | 220/62 |
| 4,082,825 | A * | 4/1978 | Puterbaugh | F25D 23/064 | 264/46.7 |
| 4,586,348 | A * | 5/1986 | Nakayama | F25D 23/062 | 403/402 |
| 4,632,470 | A * | 12/1986 | Jenkins | F25D 23/062 | 312/138.1 |
| 4,953,362 | A * | 9/1990 | Shoji | A47F 3/005 | 62/297 |
| 4,958,890 | A * | 9/1990 | Anderson | F25D 23/062 | 312/406.2 |
| 5,899,546 | A | 5/1999 | Avendano et al. | | |
| 6,036,293 | A | 3/2000 | Anell et al. | | |
| 7,108,341 | B2 * | 9/2006 | Myers | F25D 23/066 | 312/352 |
| 7,293,848 | B2 | 11/2007 | Myers et al. | | |
| 8,500,225 | B2 | 8/2013 | Kim et al. | | |
| 11,168,935 | B2 * | 11/2021 | Wong | F25D 23/006 | |
| 11,326,829 | B2 * | 5/2022 | Floquet | F25D 29/006 | |
| 2014/0345316 | A1 | 11/2014 | Godbole et al. | | |
| 2017/0102176 | A1 * | 4/2017 | Estill | F25D 23/067 | |
| 2019/0368806 | A1 * | 12/2019 | Floquet | F25D 23/028 | |

FOREIGN PATENT DOCUMENTS

| | | | | | |
|---|---|---|---|---|---|
| CN | 104105934 | | 10/2014 | | |
| CN | 106440608 | | 2/2017 | | |
| FR | 1393154 | A * | 3/1965 | F25D 23/065 | |
| GB | 671283 | A * | 4/1952 | F25D 23/062 | |
| JP | 2013119873 | A | 6/2013 | | |
| KR | 1020070019233 | | 2/2007 | | |
| KR | 20090006440 | U | 6/2009 | | |
| KR | 2020090006440 | U * | 6/2009 | F25D 23/06 | |
| WO | WO-2016174148 | A2 * | 11/2016 | E05F 15/00 | |
| WO | WO-2016174149 | A1 * | 11/2016 | F25D 23/06 | |

OTHER PUBLICATIONS

International Preliminary Report on Patentability & Written Opinion of the International Searching Authority, PCT/NZ2019/050122, Form PCT/B/373 & Form PCT/ISA/237, dated Mar. 9, 2021.
Supplementary European Search Report, EP19859114A, Form 1507, dated Jul. 13, 2022.

* cited by examiner

REFRIGERATION APPLIANCE CABINET

This application is a National Phase Filing of PCT/NZ2019/050122, having an International filing date of Sep. 12, 2019, which claims priority of New Zealand Patent Application No. 746328, filed Sep. 12, 2018. The disclosure of the foregoing are hereby incorporated by reference.

TECHNICAL FIELD

The present invention relates to a cabinet assembly for a refrigeration appliance, and a refrigeration appliance comprising such a cabinet.

BACKGROUND ART

Since the 1960's refrigeration appliance cabinets (including free-standing and "built-in" refrigerators, freezers, combined refrigerator-freezers, cooling drawer-type refrigerators, wine cabinets and chest freezers) have been manufactured with "in situ" foamed polyurethane (PU) insulation. This construction usually has a sheet steel "wrapper" or skin on the outside, either a plastics (polystyrene-based) or sheet steel liner on the inside, and a rigid PU foam in a sandwich construction between the outer wrapper and the inner liner. The outer sheet steel wrapper was typically folded to produce a forward-facing flange that was welded at the corners.

With the drive to make refrigeration appliances more cost-efficient, the sheet steel outer panels have become thinner and the welding of the corners of forward facing flanges has been eliminated. Thus the modern refrigeration appliance cabinet relies on the sandwich construction of the outer wrapper, foam and inner liner for its structural integrity. This may be satisfactory for short-term loads, but the long-term loading from the door and food placed in shelving on an inner side of the door will force the cabinet structure to creep due to shear deflection of the foam, allowing the door to drop or droop relative to the cabinet. As the door droops, misalignment with the forward-facing cabinet flange occurs such that a door seal may not engage with the flange over at least a part of its extent and cold air may escape from a cooling compartment or compartments formed by the liner. The problem is exacerbated in tall or wide refrigeration appliance cabinets which may have a heavier door and carry more weight in the door, presenting a greater force acting to deform the refrigeration appliance cabinet. Also, there is a modern trend towards "built-in" appliances which include an additional, and often heavy, door panel attached to the outside of the cabinet door so that the appliance may match surrounding cabinetry thus accentuating door droop.

This door drop is usually countered by adding structural steel to the perimeter of the cabinet, behind the forward-facing flange. The structural steel has the disadvantage that it presents a thermal heat flow path that allows heat leakage into the cabinet, reducing operational efficiency.

The above-explained door-drop issue is a particular consideration for modern full height single-door cabinets because of the increased weight of the door and any food items supported thereby, but is also problematic for multi-door cabinets (one door vertically positioned above another, each door providing access to one or more compartment) and for cabinets combining a door (or doors) with a drawer (or drawers), particularly a door above a drawer. As will be explained below, a door providing access to an upper compartment (so that its lower hinge is offset from the cabinet bottom to accommodate a lower door or drawer) can be particularly problematic for a cabinet that is not torsionally stiff (for example, if it is not reinforced with steel around its front opening), exacerbating the door droop issue.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF INVENTION

It is an object of the present invention to provide an improved refrigeration appliance assembly or an improved refrigeration appliance that will go at least some way towards overcoming at least some of the above-mentioned disadvantages, or which will at least provide the industry or public with a useful choice.

In a first aspect, the invention consists in a refrigeration appliance assembly comprising:

- a cabinet comprising five closed faces and an open face providing access to an interior of the cabinet, the five closed faces including opposing first and second side faces and a rear face, opposite to the open face, connecting the side faces together,
- a partitioning member spanning the open face and connecting the first and second side faces of the cabinet together, the partitioning member dividing the open face into upper and lower open regions, and
- at least one diagonal restraint spanning diagonally across the cabinet from or adjacent to one side face to, or adjacent to, the other side face.

Preferably, first and second diagonal restraints are provided, the diagonal restraints arranged in a cross formation.

Preferably, the diagonal restraint or restraints are in a substantially horizontal plane.

Preferably, the first and second side faces have a front edge region adjacent the open face and lateral end regions of the partitioning member, and an intersection between each side face and the rear face comprises a rear corner region, wherein each diagonal restraint extends from either a respective front edge region of one of the first or second side face to the rear corner region of the other side face.

Preferably, the at least one diagonal restraint is both fixed to a side region of the rear face and to a side face.

Preferably, the at least diagonal restraint comprises a solid rod or a hollow tube.

Preferably, the at least one diagonal restraint has a circular cross-section along at least a majority of its length.

Preferably, the at least one diagonal restraint is substantially straight with opposing ends, each end having a coupler formed therein and/or attached thereto for connection to at least one cabinet closed face and/or the partitioning member.

Preferably, the connection between at least one of the couplers and an adjacent cabinet closed face or the partitioning member is adjustable to alter the tension in a diagonal restraint, the adjustable connection accessible from outside the cabinet.

Preferably, one of the couplers comprises a bracket on the cabinet or the partitioning member, a diagonal restraint passing through a surface of the bracket facing an end of the diagonal restraint, the surface engageable with a stopper on the diagonal restraint, the stopper movable along, but constrained from moving past an end of, the diagonal restraint.

Preferably, the stopper comprises an externally-threaded boss about the diagonal restraint and an internally-threaded nut about the boss, wherein the boss is non-rotationally coupled to the bracket.

Preferably, one of the couplers comprises a flattened region with a pin protruding therefrom or therethrough, a side face of the cabinet and/or the inner face of the partitioning member adjacent said cabinet side face is provided with a flattened tab protruding therefrom into the interior of the cabinet, the flattened tab being in a substantially horizontal plane and having an aperture formed therein, the pin of the coupler passing through the aperture in the flattened region so that the at least one diagonal restraint is pivotally connected to the side face and/or the partitioning member.

Preferably, one of the couplers comprises a threaded shaft and a threaded nut, at least one of a side face and the rear face of the cabinet is provided with a bracket having a face located within the interior of the cabinet and adjacent to the side and/or rear face of the cabinet, with an aperture therein aligned to receive the threaded shaft therethrough, the threaded nut wound onto the threaded shaft and adapted to engage the bracket face.

In a second aspect, the invention consists in a refrigeration appliance assembly comprising:

a cabinet comprising five closed faces and an open face providing access to an interior of the cabinet, the five closed faces including first and second opposing side faces and a rear face, opposite to the open face, connecting the side faces together, and an internal perimeter frame comprising a plurality of leg members arranged to form a closed geometric shape surrounding a central opening and positioned within the cabinet spanning between the opposed side faces.

Preferably, first and second leg members of the internal perimeter frame that are opposed across the central opening are each in contact with and fastened to a respective opposed side face of the cabinet.

Preferably, third and fourth leg members of the internal perimeter frame are opposed across the central opening and connect between the first and second leg members, and wherein one of the third and fourth leg members contacts with and is fastened to the rear face of the cabinet.

Preferably, the leg members of the internal perimeter frame are assembled in a substantially rectangular shape.

Preferably, the refrigeration appliance assembly further comprises at least one gusset member, the or each gusset member extending between, or forming part of, a respective pair of adjacent leg members.

Preferably, the internal perimeter frame extends in a plane that is substantially perpendicular to the side faces.

Preferably, the leg members of the internal perimeter frame are each substantially planar members extending in a common plane.

Preferably, the leg members are each substantially channel-shaped in lateral cross-section.

Preferably, a front leg member of the internal perimeter frame spans the open face and connects the first and second side faces of the cabinet together to divide the open face into upper and lower open regions.

Preferably, the refrigeration appliance assembly further comprises a torsionally stiff structure fixed to or comprising one of the five closed faces to substantially increase torsional stiffness of the assembly beyond that of the cabinet alone so that the cabinet has an increased ability to resist twisting.

Preferably, the torsionally stiff structure is fixed to or comprises a bottom face or a top face of the cabinet.

Preferably, the torsionally stiff structure forms a plinth for the cabinet.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the terms "pivotally" and "rotationally" (for example, the door is pivotally/rotationally connected/attached/coupled to a cabinet) includes both a purely rotational relative movement about an axis, as well as a combination of rotation about an axis and translation of that axis (an example of the combined rotation and translation being provided by a door connected to a cabinet by an articulated hinge).

The terms "torsionally stiff" and "torsionally weak" (and equivalents) used herein are relative terms meaning, respectively, having the ability to substantially resist twisting by a torque/moment resulting from an applied force in an operational range normally expected to be encountered by a refrigerator cabinet, and not having the ability to substantially resist that torque/moment.

As used herein the term "and/or" means "and" or "or", or both. As used herein "(s)" following a noun means the plural and/or singular forms of the noun. The term cuboid is intended to mean, unless the context indicates otherwise, a 3-dimensional structure such as a rectangular prism, comprising six main sides or faces (for example a rectangular cuboid or a square cuboid). One or more main sides may be open faces, for example an open framework (a space frame) or closed faces of the cuboid.

This invention may also broadly be said to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF DRAWINGS

Preferred embodiments of the invention will be described by way of example only and with reference to the accompanying drawings, in which.

DESCRIPTION OF EMBODIMENTS

Figure 1A:
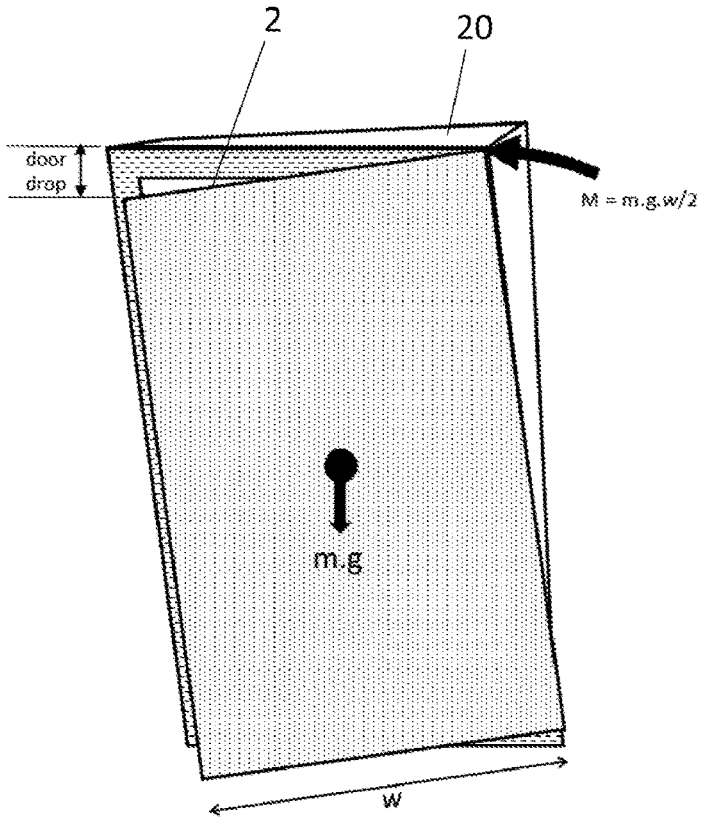
FIG. 1A is a schematic front view representation of a refrigeration appliance illustrating deformation or twisting of a torsionally weak cabinet and the resulting 'door drop' or droop caused, over an extended period of time, by the mass of the door and food supported by the door.

Various embodiments will now be described with reference to the drawing Figures. Throughout the drawing Figures and specification, the same reference numerals may be used to designate the same or similar components, and redundant descriptions thereof may be omitted.

Single-Door Refrigeration Appliance Cabinet Example

Figure 6A:
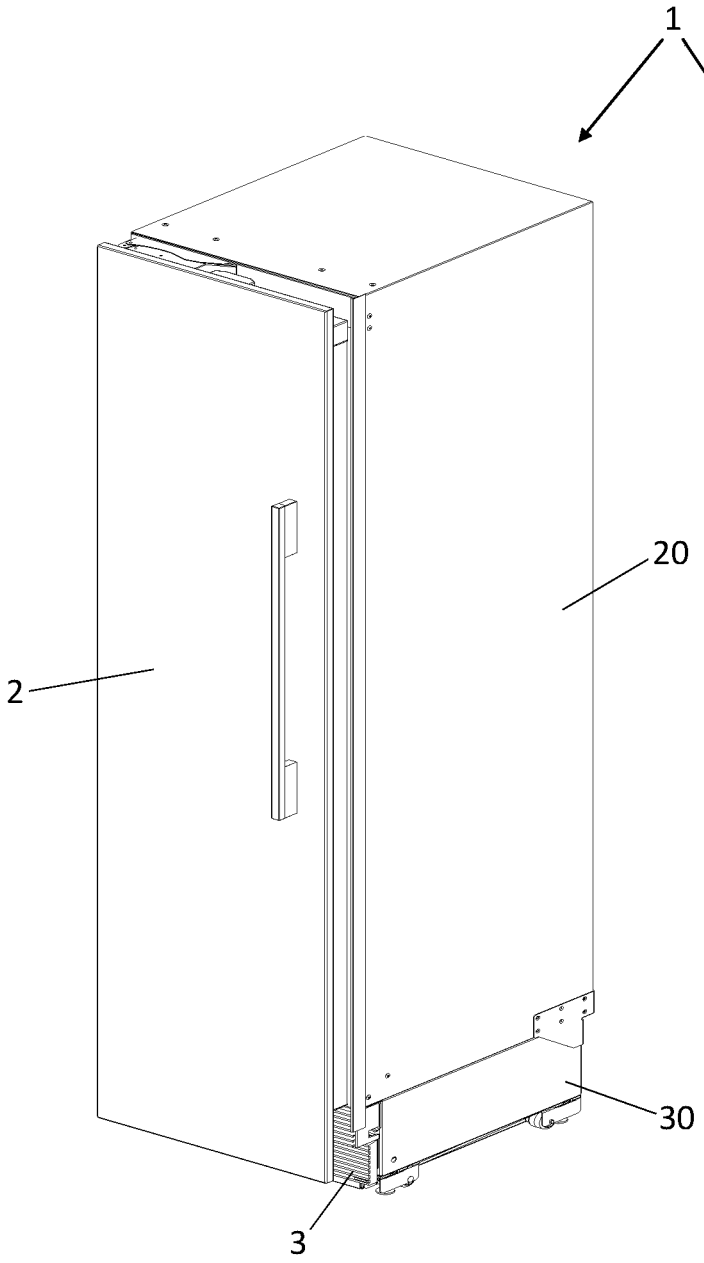
FIGS. 6A and 6B illustrate a fully-assembled refrigeration appliance comprising the cabinet with torsionally-stiff structure shown in FIG. 3A or 3B, FIG. 6A being an isometric view and FIG. 6B a front view.
Figure 6B:
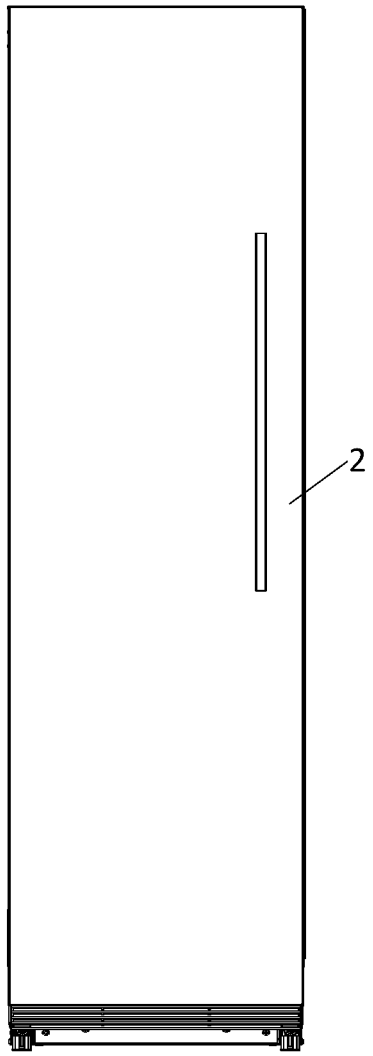

A refrigeration appliance 1 is illustrated in FIGS. 6A and 6B. The refrigeration appliance comprises an insulated cabinet 20 with an open front face, and a door 2 for selectively opening and closing the front face. The overall height of the refrigeration appliance may, for example, be around 84 inches (around 213 cm) which is relatively tall for modern refrigeration appliances. The door 2 is openably operatively connected (such as via a rotational or pivotal connection) to the cabinet 20 by hinges (such as articulated hinges, one of which is visible at the top edge of the door in FIG. 6A) at one side thereof to selectively close the open face of the cabinet. The door may have shelves on an inner side for supporting food or bottles. The refrigeration appliance shown in FIGS. 6A and 6B is of the "built-in" variety and so its outer front face is part of a door panel removably and adjustably attached to the actual hinged insulated cabinet door below.

Figure 1B:
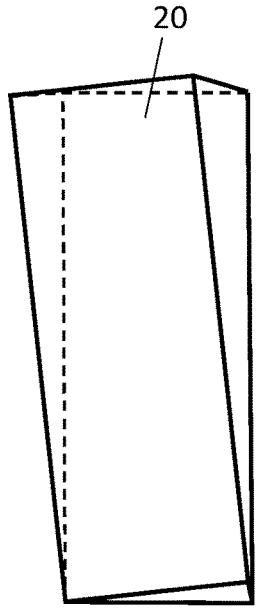
FIG. 1B is a schematic representation side view from a door hinge side of the twisted refrigeration appliance illustrated in FIG. 1A, FIGS. 2A to 2D illustrate exemplary torsionally stiff structures, FIGS. 3A and 3B each show a different embodiment of a refrigeration appliance assembly including a common torsionally weak cabinet and a torsionally-stiff structure located at a base or bottom side of the cabinet, FIGS. 4A and 4B each show an enlarged view of the box or cuboid structure that, together with the base panel (not shown) of the attached cabinet, forms one of the torsionally stiff structures in FIGS. 3A and 3B, respectively.

With reference to FIGS. 1A and 1B, a mass m of the door 2 (and any food supported on shelves on the inner side of the door) creates a moment M at a side of a torsionally weak insulated refrigeration appliance cabinet 20 to which the door is pivotally/rotationally connected. The moment M forces the rectangular front open face of the refrigeration appliance cabinet (and each of the other faces) into a substantially parallelogram shape, when viewed from the front of the cabinet.

The refrigeration appliance cabinet 20 comprises five closed faces; the left and right sides, top, bottom and back faces. By "closed", it is meant that the side or face does not allow a user access therethrough for adding/removing articles to/from a volume enclosed by the cabinet whereas an "open" side or face allows a user access therethrough to the enclosed volume.

Cabinet 20 may, at least in part, be formed by folding sheet metal (such as painted steel or stainless steel) to form at least a part of the cabinet wrapper. For example, the two longer, vertical side panels/closed faces and the top panel/closed face may be formed by folding a single sheet of metal into a substantially upside-down "U"-shape and the back and bottom panels/closed faces may be attached thereto by, for example riveting or welding. If the five closed faces are rigidly joined (or continuous, in the case of folding to form at least some of the panels) along their coincident edges, the moment M produced by the door's weight will cause the cabinet to deflect as shown in FIGS. 1A and 1B, with each of the edges retaining their original length. The only significant deformation is that all five closed faces of the cabinet twist. Being formed from a material such as sheet steel, each closed face is very stiff in the planar direction of the face, however each face can bend or twist out of its plane. To aid in understanding, the shape of a deformed cabinet and face resulting from moment M acting on the torsionally weak cabinet may be reproduced by holding still one of the top or bottom faces of a torsionally weak rectangular prism (such as a cardboard box) while twisting the other of the top or bottom face of the box about an axis through the top and bottom faces.

One aim of the present invention is to actively eliminate the twist in one face of the cabinet. Actively eliminating twist in one face of the cabinet passively prevents or obstructs all of the other cabinet faces twisting and therefore prevents the entire cabinet from deforming significantly. Deformation of the refrigeration appliance cabinet, and therefore door drop relative to the cabinet, is eliminated or reduced to an acceptable level by adding a torsionally rigid or stiff structure to one of the five closed faces of the cabinet. That is, a structure is added (i.e., attached, coupled, fixed or connected) to the cabinet so that the torsional rigidity/stiffness of the resulting assembly (i.e., cabinet+structure) is greater than that of the cabinet alone.

In some embodiments, the cabinet comprises an outer skin or wrapper, inner liner, and an insulating material in between. The sheet steel forming the wrapper may be for example steel sheet with a thickness of less than 1 mm, preferably between about 0.4 mm and 0.6 mm, most preferably about 0.5 mm. The cabinet is a torsionally weak structure, due at least in part to the relatively thin section of the sheet material. The folded corners or edges between the side and top panels present relatively rigid edges between the top and sides of the cabinet. Connections between the "U"-shaped sheet and the base and back panels are also rigid, for example by riveting or by other connecting means known in the art. The front of the cabinet comprises an open face to provide access to the inside of the cabinet via a door of the refrigeration appliance.

Torsionally weak, in relation to the cabinet, means that in response to an appropriately-directed force or moment having a magnitude within an expected operational loading range, the closed faces of the cabinet can relatively easily twist out of plane. As a result the cabinet twists and the shape of the open front face of the cabinet deforms from a rectangle to a parallelogram (when viewed from in front of the cabinet) which is no longer substantially planar. Deformation of the cabinet may prevent the door from sealing the cooling compartments within the cabinet when in a closed position.

In order to prevent the torsionally weak cabinet from twisting, a torsionally stiff structure is provided to one of the five closed faces of the cabinet. For example, a torsionally stiff structure may be provided to the top face or the bottom face of the cabinet. Alternatively, a thin torsionally stiff structure may be provided to a left or right side face, or a rear face of the cabinet. In a preferred embodiment, a torsionally stiff structure is applied to the bottom or top closed face of the cabinet since typically within a building space (e.g., in a kitchen) in which a refrigeration appliance is located there is sufficient vertical height to accept a torsionally stiff structure above or below the cabinet. The torsionally stiff structure may be an auxiliary structure, attached to the cabinet subsequent to the cabinet's construction, or it may be built into the cabinet structure during the cabinet's construction. At least a part of the torsionally stiff structure may also be formed integrally with at least part of the cabinet (for example, as a folded box formed from the same sheet of steel as one or more of the panels of the cabinet) or could be formed from components completely distinct and separate from components used in the construction of the cabinet. The torsionally stiff structure could be a combination of an auxiliary structure and an existing part (such as a side or face) of the cabinet.

A torsionally stiff structure is a structure that does not significantly twist under normal operational loading. That is, when one end or face of the structure is held firmly, the structure is able to resist rotation of an opposite end of the structure about an axis through both ends (see FIG. 1A). A thick solid plate may be sufficiently rigid to act as a torsionally stiff structure, for example a thick steel plate having a thickness of more than 5 mm. The torsionally stiff structure could be a continuous, solid thick plate or could be a frame (e.g. a 2-dimensional frame like a picture frame) cut from a solid thick plate. However, a thick plate or frame may be less preferred as it may provide a thermal heat flow path to the inside of the refrigeration appliance (if used on the inside of the wrapper such that it displaces an amount of insulation) and is an inefficient use of material.

Exemplary torsionally stiff structures that are efficient in their material usage are illustrated in FIGS. 2A to 2D. In some embodiments, the torsionally stiff structure comprises a 3-dimensional framework. In some embodiments, the torsionally stiff structure comprises a hollow cuboid or rectangular prism, e.g. a cuboid framework or a hollow cuboid with one or more closed faces.

Figure 2A:
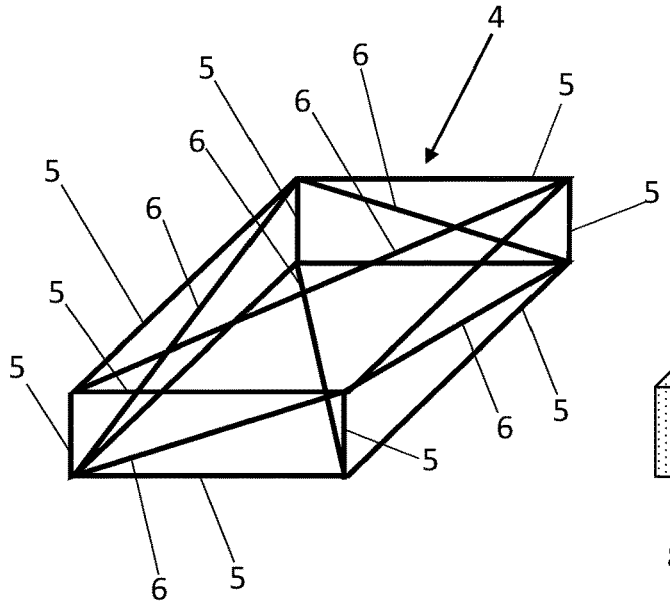

FIG. 2A illustrates a torsionally stiff structure comprising a cuboid space frame 4, the space frame 4 comprising a rigid member or strut 5 along or forming each edge of the frame and rigid diagonal members 6 across each open face or side of the space frame between diagonally opposed corners. The diagonal members 6 may be oppositely arranged in opposing sides of the framework 4. In some embodiments, each side of the space frame may comprise a diagonal member between adjacent perimeter edge members. In some embodiments the space frame 4 may comprise a diagonal member across five sides of the framework, and with a single side without a diagonal member to be attached to a closed side of the cabinet. In some embodiments the space frame may be without diagonal members, for example in a welded construction comprising edge members 5 that provide sufficient corner rigidity without diagonal members.

Figure 2B:
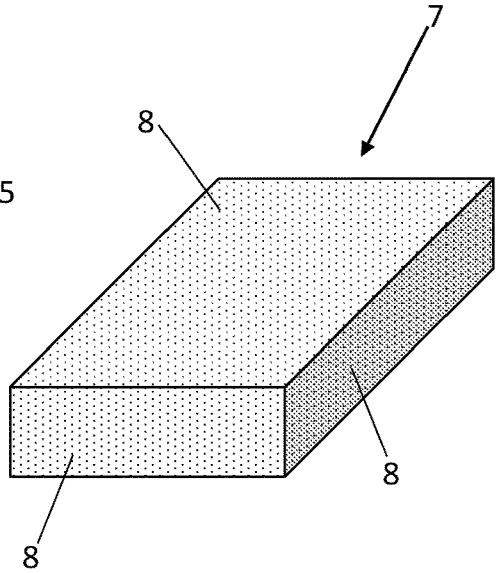

FIG. 2B illustrates a torsionally stiff structure comprising a sheet metal box 7 or cuboid. All six main sides 8 of the box comprise sheet metal, e.g. a sheet metal panel such as sheet steel. The thickness of the sheet metal-forming closed faces of the box is sufficiently thick to prevent twisting of the box. For example, where the thickness of the outer skin of the torsionally weak cabinet is about 0.5 mm, the thickness of the sheet metal box formed from the same material (such as sheet steel) as the cabinet and providing a torsionally stiff structure may be between about 0.5 mm to about 1.5 mm. The thickness of the sheet metal forming the box may, purely as an example, be at least about 1.5 times the thickness of the outer skin of the refrigeration appliance cabinet. Some faces could be thinner than others.

Figure 2C:
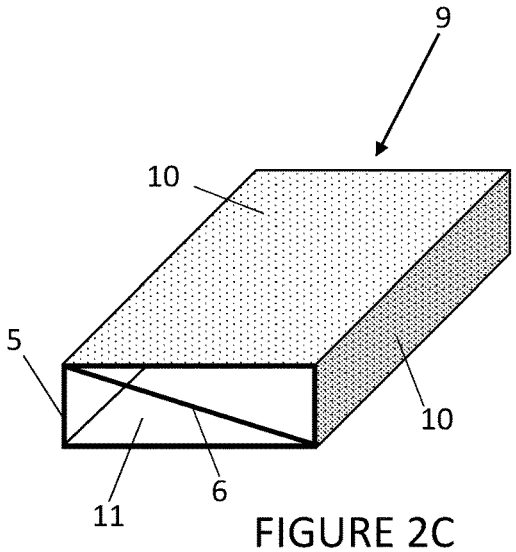

FIG. 2C illustrates a torsionally stiff structure comprising a box or cuboid 9 having five sheet metal, closed faces 10 and a sixth face or side 11 (the front side in the drawing figure) comprising a framework. The framework comprises four rigid perimeter or edge members 5 and a rigid diagonal member 6 in the plane of the open face to stiffen the open face. Other combinations of closed and open faces may be provided, for example a structure comprising four sheet metal, closed faces 10 and two opposed, open framework faces 11, each framework face comprising four rigid perimeter members 5 and one or more rigid diagonal member(s) 6 for stiffening an open face or faces, for example as described with reference to FIG. 2A. As an alternative to diagonal stiffening members, open faces could be stiffened by corner gussets, for example.

Figure 2D:
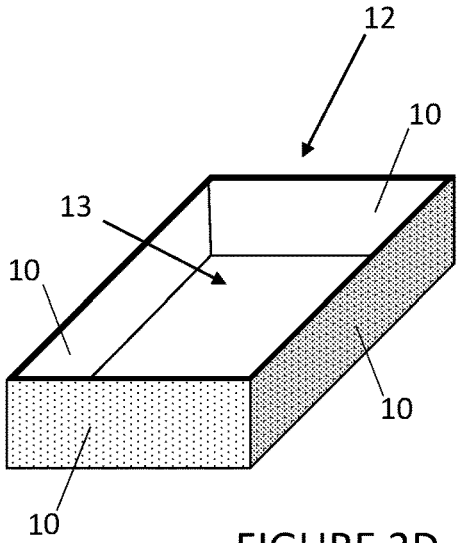

FIG. 2D illustrates a box or cuboid 12 comprising five sheet metal closed faces 10 and a sixth, open face 13. A closed face of the torsionally weak cabinet closes or provides the sixth face of the torsionally stiff structure.

In some embodiments the torsionally stiff structure comprises a cuboid sized to accommodate components of a refrigeration system of the refrigeration appliance, for example a compressor and condenser with pipework connecting to at least one evaporator for cooling at least one compartment within the cabinet. For example, the structures illustrated in FIGS. 2A to 2D may be formed to encompass a sufficiently large volume to beneficially accommodate such a refrigeration system, in addition to preventing or reducing twisting of the cabinet.

Figure 3A:
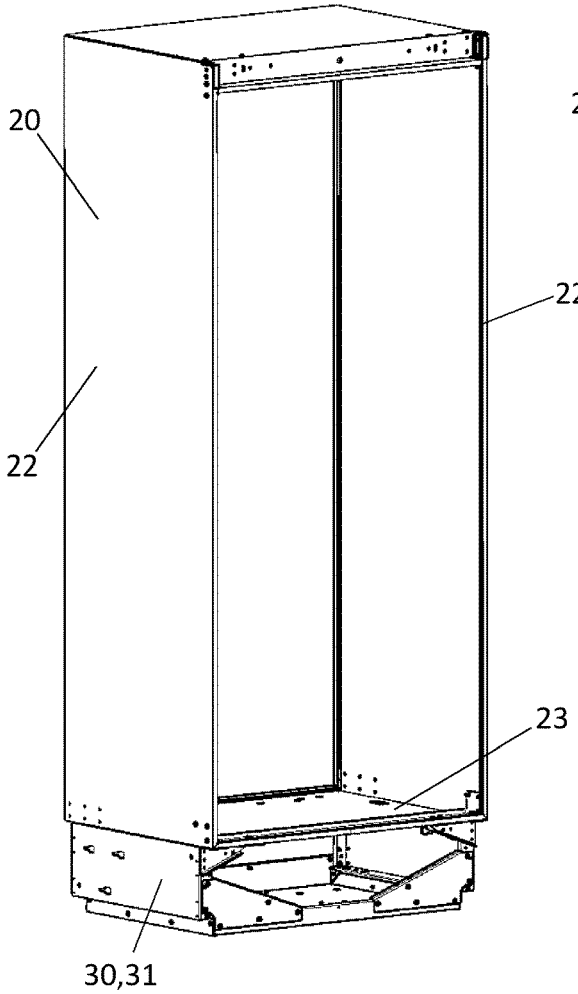
Figure 3B:
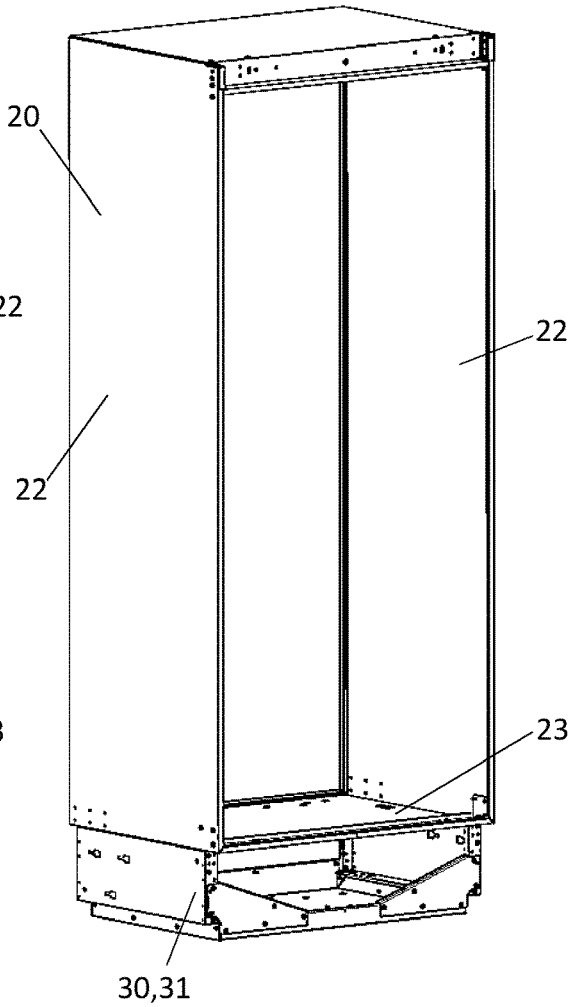

FIGS. 3A and 3B show two embodiments each comprising a torsionally weak cabinet 20 and a torsionally stiff structure 30 located at and rigidly secured to a base or bottom side of the torsionally weak cabinet 20. The illustrated cabinet 20 may be the outer skin for an insulated cabinet comprising the outer skin, an inner liner and insulation between the outer skin and inner liner, the cabinet having five closed faces and an open front face. The torsionally stiff structures 30 in FIGS. 3A and 3B are each sized to house components of a refrigeration system for the refrigeration appliance. As the torsionally stiff structure is located at the bottom of the cabinet the torsionally stiff structure beneficially acts as a plinth for the cabinet to house refrigeration components below the cabinet and raise the cabinet (and its enclosed compartments) slightly to ease access by a user.

Figure 4A:
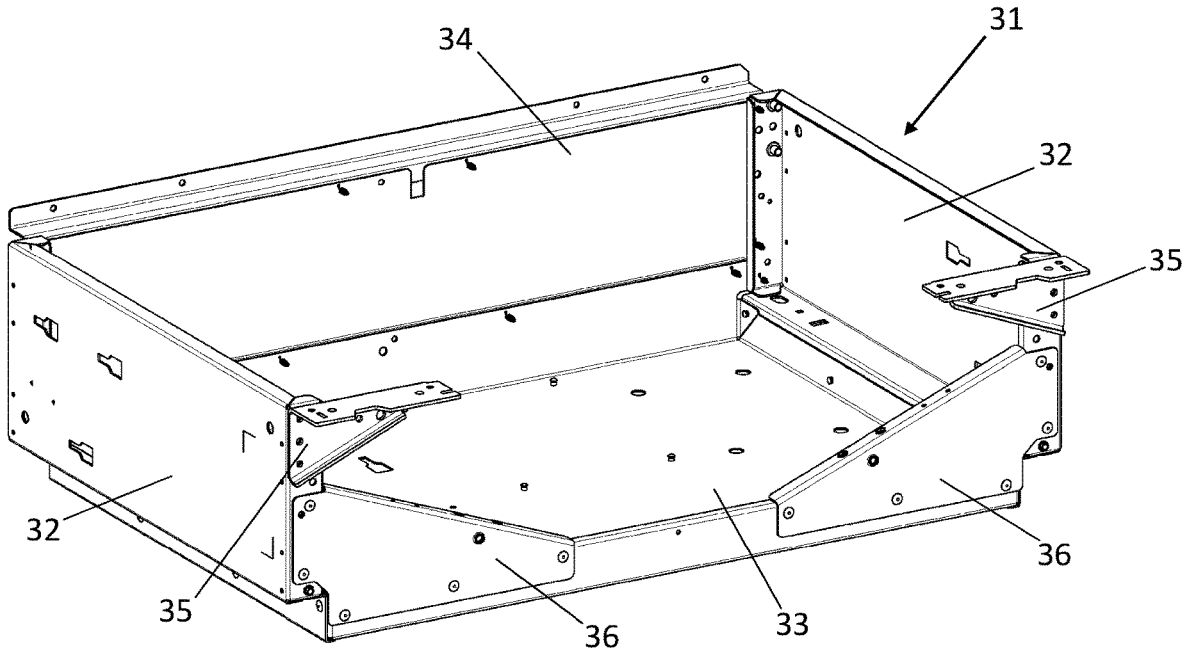
Figure 4B:
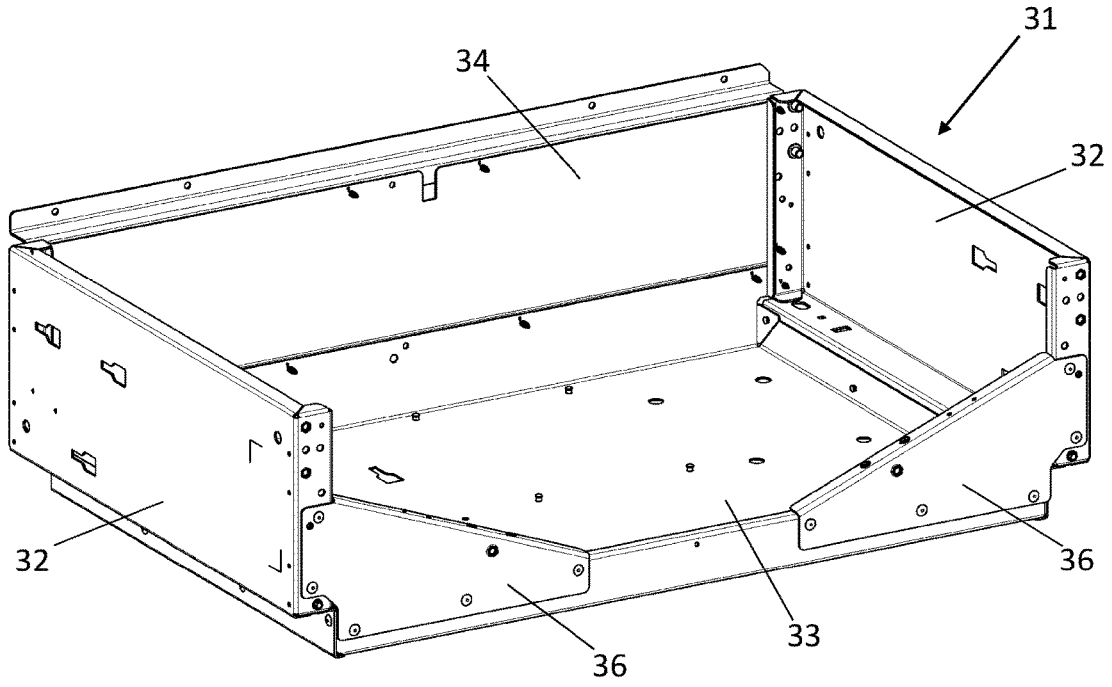

In each of FIGS. 3A and 3B the torsionally stiff structure 30 includes a cuboid or box 31. The box 31 shown together with the cabinet 20 in FIGS. 3A and 3B is shown separated from the cabinet 20 in FIGS. 4A and 4B. The box 31 comprises four main closed faces; left and right faces 32, a bottom face 33 and a rear face 34. A front side is open and the box is stiffened by corner gussets 35, 36 provided at or near to the open front face of the box 31. The open front face allows for access to the refrigeration system components, for example for maintenance and/or for air flow. The open front face may be covered by a grill or grate, e.g. grate 3 shown in FIG. 6A. The door 2 (or at least the outer panel attached to the actual door) of the refrigeration appliance may cover the front face of the box 31 when in a closed position, as shown in FIG. 6A. Each gusset is attached to two adjacent sides of the box, or to a side of the box and a face of the cabinet 20. For example, in the figures each gusset 36 is attached to a vertical side 32 and a horizontal side 33 of the structure while each gusset 35 is attached to a vertical side 32 and the base panel 23 of the cabinet 20. In FIGS. 3A and 4A the box 31 is stiffened by four gussets 35, 36. Two gussets 36 are attached to a vertical side 32 and to the bottom side 33 of the box, and two gussets 35 attached to vertical side 32 and bottom face 23 of the cabinet 20, the four gussets 35, 36 positioned at each corner of the open face so that a considerable central opening remains in that face. In FIGS. 3B and 4B, the box is stiffened by two gussets 36, each attached to a vertical side 32 of the box and the bottom 33 of the box 31.

The gussets may be formed from the same sheet steel material (and thickness) as the material used to form box 31. In some embodiment two gussets or four gussets may be integrally formed, e.g. cut and/or folded to form a monolithic component from a single blank or sheet material. The gussets may be substantially planar and attachment to a panel may be via a flange formed on that panel, perpendicular to the panel, such as gusset 36. Alternatively, the gussets could be formed with a perpendicular flange at an edge or edges thereof adapted to be fastened directly to the face of an adjacent panel, such as gusset 35.

Figure 5A:
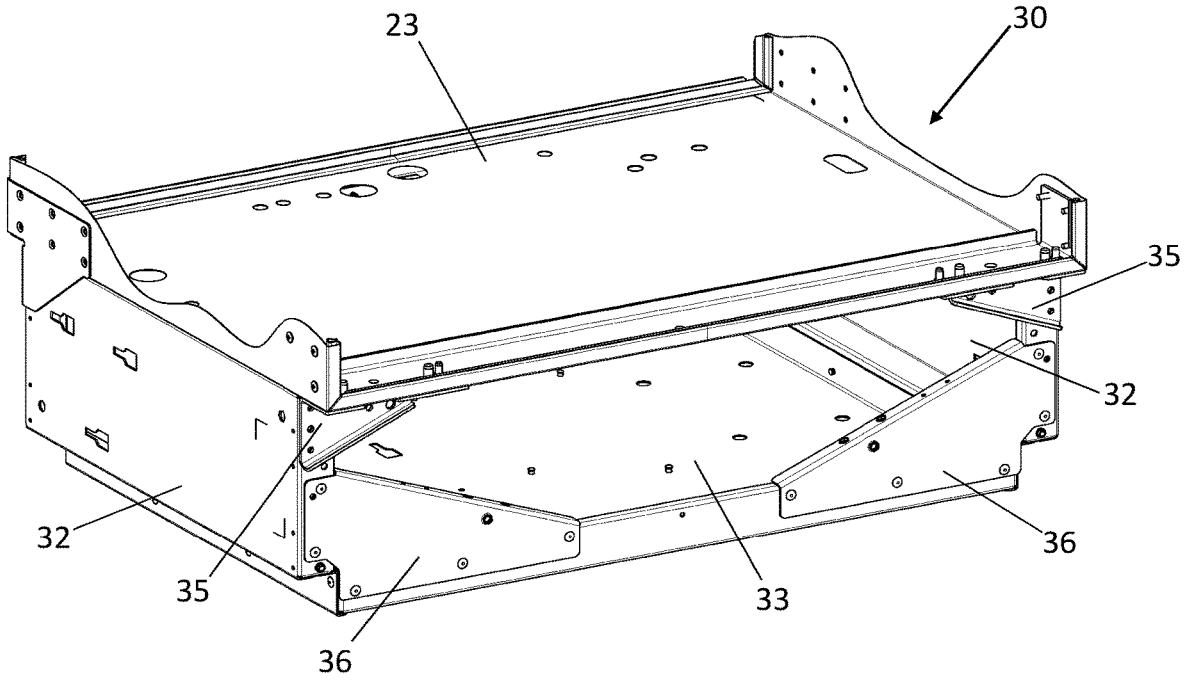
FIGS. 5A and 5B show the torsionally stiff structure embodiments in FIGS. 3A and 3B respectively, comprising the boxes from FIGS. 4A and 4B and the bottom panel of the cabinet, cut away from the vertical sides of the cabinet.
Figure 5B:
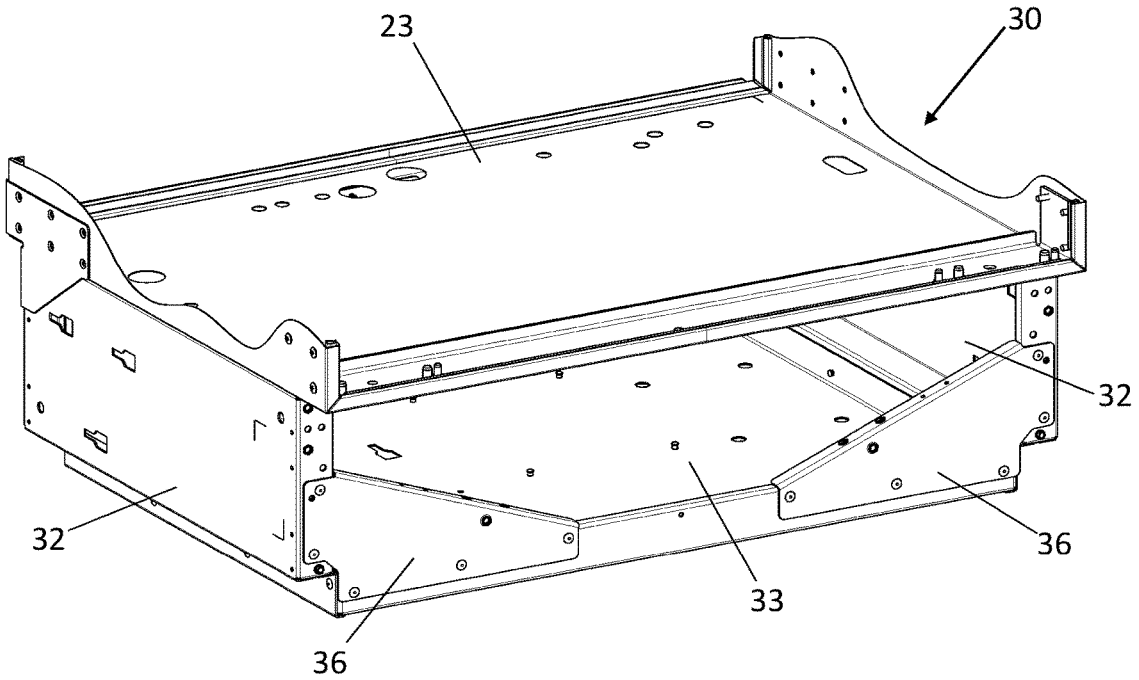

In FIGS. 3A, 4A and 3B, 4B, the top side of the box 31 is open. The open top side of the box is closed by attaching the box to the base or closed bottom face 23 of the cabinet 20, for example as explained above with reference to FIG. 2D. The box 31 is rigidly fixed to the bottom side 23 of the cabinet. Thus in FIGS. 3A and 3B, the bottom panel 23 of the cabinet closes the top side of the box 31 to create a torsionally stiff structure 30 comprising five closed main sides (the top 23, bottom 33, rear 34 and left and right sides 32) and an open front with two or four gussets at the open front. FIGS. 5A and 5B show the torsionally stiff structure 30 comprising the box 31 and the bottom panel 23 of the cabinet cut away from the vertical sides 22 of the cabinet 20. In use, the cabinet bottom 23, which is also the top side of the torsionally rigid structure 30, is prevented from twisting because it is an integral part of a torsionally stiff assembly comprising the other five sides of the box 31, which thereby prevents the entire cabinet 20 from twisting.

It will be appreciated that the box 31 itself, having an open top face, is not substantially torsionally stiff, but when rigidly fixed to base 23 the torsionally stiff structure 30 results. Alternatively, the box could also include a closed upper face, thereby increasing the torsional stiffness of the box and making the box itself torsionally stiff. The closed upper face of the torsionally stiff box could then be rigidly fixed to the cabinet bottom face 23 to produce a refrigeration cabinet assembly having a torsional stiffness greater than the torsional stiffness of the cabinet on its own.

The cabinet must be reliably and strongly attached to the torsionally stiff structure without allowing relative movement or flexing therebetween, otherwise the cabinet will be able to twist. In some embodiments the torsionally stiff structure or box is rigidly fixed to the outer skin of the cabinet by welding, riveting, screws or other suitable fasteners, or by any other rigid fixing means know in the art that will substantially avoid any relative sliding movement between adjacent faces of the cabinet and torsionally stiff structure.

The left and right sides 32, bottom 33 and rear 34 sides of box 31 may be folded from sheet metal, or may be separate panels fixed together, or any combination of folding and fixing. The thickness of the sheet metal may be thicker than the thickness of the outer skin of the cabinet. The gussets may be formed from sheet metal and may have the same thickness as the metal forming the closed sides of the box or may be formed from an alternative material having adequate stiffness.

Utilising a torsionally stiff structure fixed to or comprising one face of the refrigeration appliance cabinet allows cost to be removed from the cabinet (auxiliary structural components in the cabinet such as reinforcing steel around the door opening are not required) which also improves the thermal insulation of the cabinet (by enabling insulating foam to replace the volume previously occupied by the removed heat-conducting structural components), and reduces material usage.

As mentioned above, the torsionally stiff structure may be attached to or include any one (or more) of the sides of the cabinet. The torsional resistance of the side of the cabinet with the torsionally stiff structure stops or restrains that side of the cabinet from twisting, which means that none of the sides of the cabinet can twist. Because the cabinet cannot twist, the door attached to a front open face of the cabinet cannot droop so that the door stays in alignment with the open front face of the cabinet, and the door seal stays engaged with the peripheral front flange of the cabinet door opening when the door is in a closed position.

Multiple Closure (Door/Drawer) Refrigeration Appliance Cabinet Example

With reference now to FIGS. 7 to 10, a multiple closure cabinet assembly example will now be described.

As previously mentioned, the door droop phenomenon resulting from cabinet twisting, and which is particularly noticeable in cabinets with large doors and a lack of structural steel reinforcement, is exacerbated in multiple-closure cabinets. By 'multiple closure' it is intended to encompass cabinets with multiple doors (such as vertically-displaced refrigerator and freezer compartment doors) and a cabinet with multiple vertically-displaced drawers, and a cabinet having a combination of drawers and doors. Most particularly, the exacerbated door droop effect is seen in "bottom mount" freezer compartment cabinets where a freezer compartment is provided vertically beneath a refrigeration compartment. The freezer compartment closure may be a door or a drawer but, as explained below, the door droop problem resulting from a lack of torsional rigidity is compounded by a door mounted to the upper, refrigeration compartment.

Figure 7A:
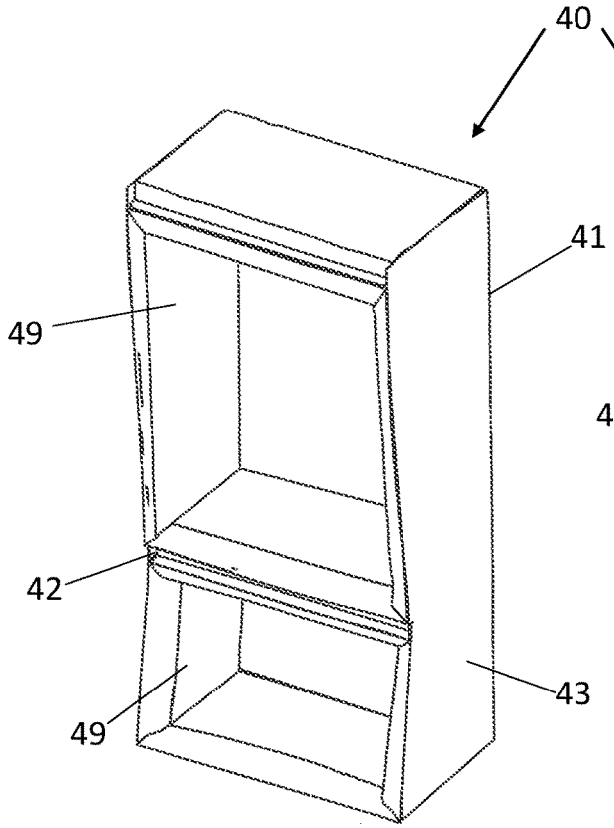
FIGS. 7A and 7B are exaggerated perspective and front elevational diagrams, respectively, illustrating the deformations occurring due to the forces acting on the cabinet of a multiple-closure refrigeration appliance assembly.
Figure 7B:
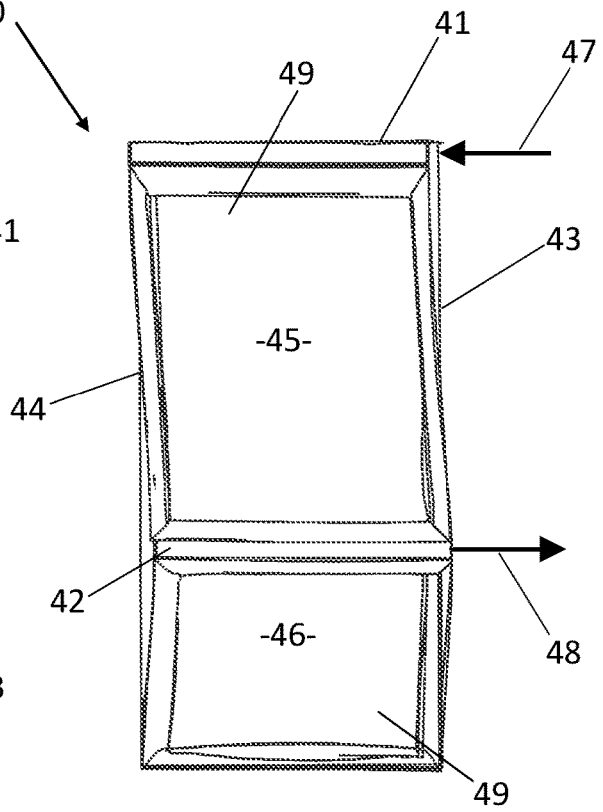

FIGS. 7A and 7B illustrate a multiple closure refrigeration cabinet assembly 40 having a cabinet 41 similar to that previously described but also incorporating a "cross-rail" 42 across the open cabinet face. It will be noted that there is no or little relative twist between the top and bottom faces of cabinet 41 and so the illustrated cabinet has some torsional stiffness. This could be, for example, due to a torsionally stiff structure (not visible in FIG. 7A or 7B) being fixedly attached to one of the cabinet's closed faces. Cross-rail 42 is a sheet metal strap spanning between and connecting the two vertical side faces 43, 44 at a vertical height to divide the cabinet into an upper 45 and a lower 46 compartment, thereby forming a partitioning member. An internal liner 49 (which, in the illustrated case, is two separate internal liners, although a single, two-chamber liner could alternatively be provided) within the cabinet may be formed from plastics or sheet metal and has five closed faces, the bottom face of which is located at or around the upper edge of the cross-rail. The internal liner is offset inwardly from the cabinet shell, the space therebetween is filled with insulating foam. Cross-rail 42 helps to maintain a fixed lateral spacing between the side faces of the cabinet while also providing a convenient fixing platform for the lower hinge bracket (not shown) in the case where the upper compartment 45 is fitted with a door. The periphery of the open face of the cabinet is provided with a "throat" assembly which spans and maintains the gap between internal liner and outer cabinet and includes a cosmetic front face for sealing with a door/drawer gasket.

Figures 8A, 8B:
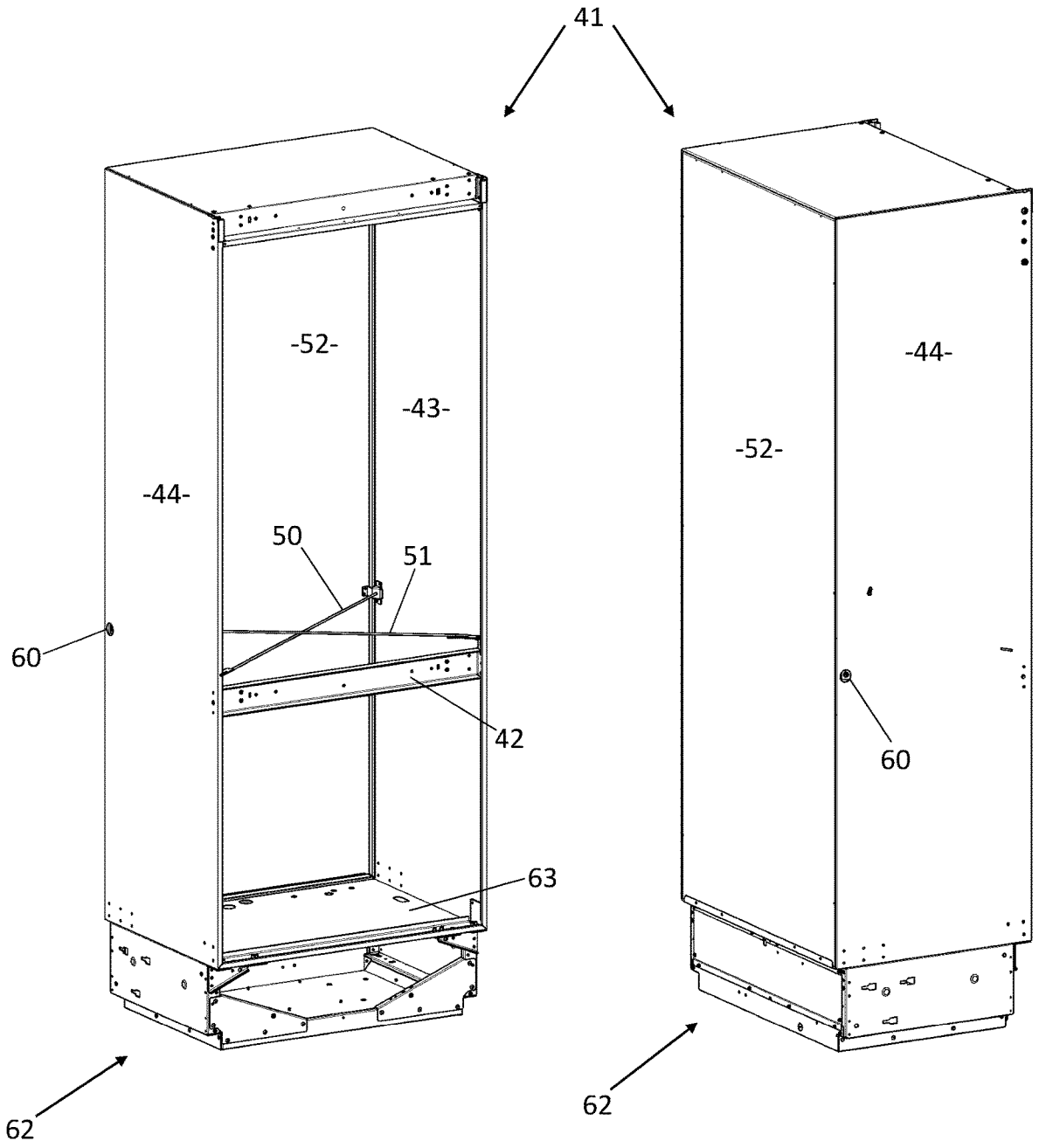
FIG. 8A is a perspective view from the front, one side and above of a multiple-closure refrigeration appliance assembly incorporating a first exemplary cabinet lateral stiffening arrangement.
FIG. 8B is a perspective view from behind, one side and above of the refrigeration appliance assembly of FIG. 8A.

Lacking any lateral loading on the cabinet, the front, open face of the cabinet is substantially rectangular (see FIG. 8A) such that the throat assembly is substantially "FIG. 8" shaped with parallel horizontal and vertical sides. However, when the upper compartment 45 is provided with a door closure, lateral forces are introduced by the door hinges. When upper compartment 45 is a refrigeration compartment the door will ordinarily be provided with internal shelving for housing food items such as bottles of liquid. For this reason, the forces exerted by the door onto the cabinet can be far greater than the mere weight of the door alone. In the case of an "integrated" or "built-in" product, an additional decorative panel can be attached to the outer face of the door thus further increasing the load on the door's hinges.

The following assumes that the upper refrigeration compartment has hinges mounted on its right-hand-side (closest to side face 43) when viewed from in front of the cabinet, although the particular mounting side is not crucial. Similar to FIG. 1A, because the centre of mass of the door is laterally spaced away from the hinge axis, the door will exert a laterally directed moment 47 on the cabinet at its upper hinge bracket (not shown), directed toward side face 44. A corresponding reaction moment 48 will be exerted on the cabinet by the lower hinge bracket, directed away from the cabinet. Unlike the single-door example previously described, the outwardly-directed force 48 is vertically displaced from the base of the cabinet and so tends to laterally displace the central region of the cabinet side faces so that face 44 generally bows inwardly and face 43 generally bows outwardly, with the same curvature as face 44.

Figure 7C:
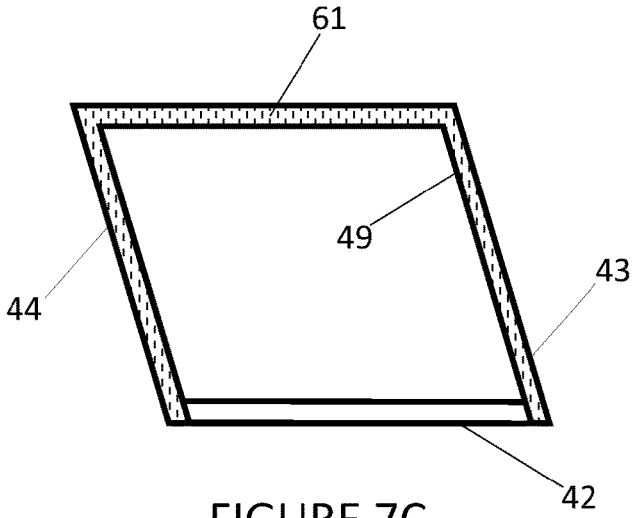
FIG. 7C is a horizontal cross-sectional view through the cabinet of FIGS. 7A and 7B at or around the height of the cross-rail.

When the lower compartment is a freezer compartment, it is usually smaller than the upper compartment so that its door is smaller and is not usually adapted to carry a food load. The lower compartment door is therefore unable to provide a significant opposing moment that would counter the bowing of the side faces. This is also the case when the lower compartment is provided with a drawer closure. In addition, when the cabinet structure is inherently torsionally weak, the aforementioned twisting deformation would also occur. The resulting deformation of a cabinet, whether or not it lacks any reinforcement to improve torsional stiffness, is that the open faces of compartments 45 and 46 are skewed so that they have a parallelogram shape as illustrated by see FIG. 7B meaning that the door will droop. A horizontal cross-section through the cabinet is therefore also forced into a parallelogram shape, as illustrated by FIG. 7C which is a view in the direction of the base of the cabinet, at a vertical height just above the base of upper compartment 45 and showing insulation foam 61.

First Exemplary Embodiment of a Lateral Stiffening Arrangement

Figure 9:
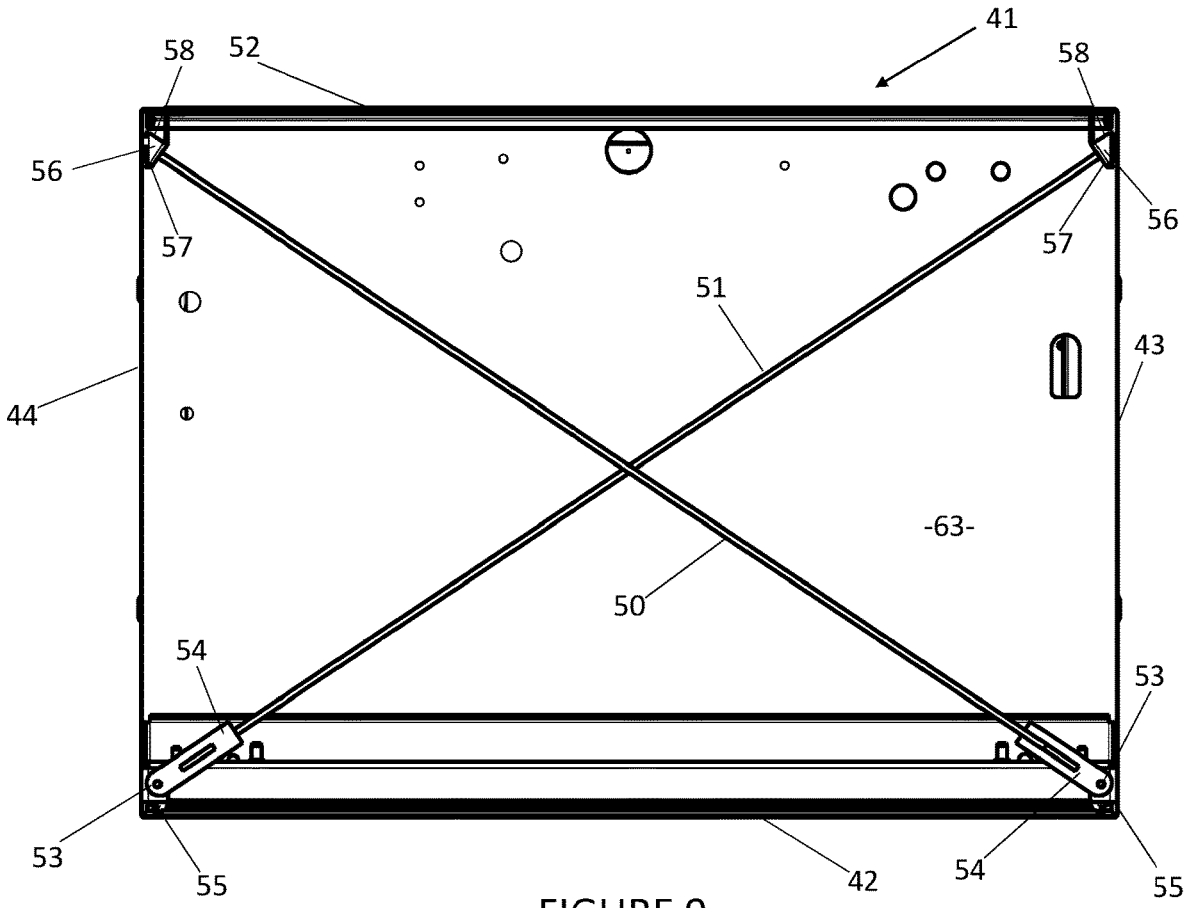
FIG. 9 is a horizontal cross-sectional view through the refrigeration appliance assembly of FIGS. 8A and 8B at a height above the lateral stiffening arrangement, looking towards the bottom face of the cabinet.

To avoid or minimise such "parallelogramming" deformation in the horizontal plane, and thereby reducing or avoiding the tendency of side walls 43, 44 to bow, a lateral stiffening arrangement is incorporated in the refrigeration cabinet assembly. For example, as shown in FIGS. 8A and 9, a first exemplary embodiment of one such lateral stiffening arrangement is shown and comprises first 50 and second 51 diagonal restraints or tie bars spanning between, and fastened to, the opposed side faces 43 and 44 and/or between each of the side faces/panels and a cabinet rear face/panel 52, in a cross formation. Ideally, the connections between the respective diagonal restraints and a particular side face are as far apart as possible. Accordingly, a first connection point or region is situated at or near the front edge of the side face and the second connection point or region is situated at or near the edge of the opposite side face at a rear corner where the side face meets the rear face. The second connection point/region could be on the rear face, close to its intersection with the side face, or the second connection point/region could contact and fasten to both the side and rear faces at a "corner" connection region where the edges of the side and rear faces meet. Preferably the first and second diagonal restraints are substantially horizontally arranged with one of the restraints passing over the top of the other. Preferably the first and second restraints 50, 51 are vertically located in the cabinet at or around the height of the cross-rail 42 so that they will be positioned in the insulation space between the inner liner's upper and lower compartments.

First and second restraints 50, 51 are preferably formed from metal rod or bar material so that they are axially stiff and can provide sufficient resistance to tensile and/or compressive stresses, rather than softer materials such as plastics or fibreglass composites which would be significantly less stiff and could potentially creep over time. For example, the first and second diagonal restraints could be formed from solid (non-hollow) circular cross-section steel rod having a diameter of between about 2 to about 10 mm, most preferably about 4 mm. Alternatively, the restraints could be formed as flat sheet metal straps or could be formed from hollow tubes such as hollow cylindrical steel tubes, or any combination of these alternatives. To minimise heat loading, the minimum diameter of rod or tube should be used. An advantage of solid circular rod over hollow cylindrical tube is that it minimises the surface contact area through which heat flows for a given solid cross-sectional area of material, thereby reducing heat transfer or "heat loading" into the compartments.

As may be seen in FIGS. 8A and 9, the diagonal restraints may be substantially straight with either end of a restraint having a fastening coupler formed therein and/or attached thereto to fasten the ends of the restraint to or near the respective side and/or rear face(s). For example, at the front edge of the side face, the forward ends of the restraints may be provided with a coupling comprising a pivot pin 53 protruding substantially vertically from an adaptor plate 54 welded or otherwise fastened to an end of a solid steel rod 50/51. A peripheral edge bracket 55 is welded, riveted, screwed or otherwise fastened to the side face 43, 44 at or near the edge of the open face, the bracket having an aperture (not visible) therein for receiving pivot pin 53. Preferably, bracket 55 is formed from sheet metal such as sheet steel, folded or otherwise formed to incorporate side face contacting legs or tabs and a substantially horizontal, in use, face or tab in which the pivot pin-receiving aperture is formed. Once the pivot pin is inserted in the aperture in the bracket, and optionally secured therein to resist removal of the pin, the forward end of the restraint is fastened to the side face while allowing pivotal movement about the pin axis. Although bracket 55 is illustrated as attached solely to the front region of a side wall 43, 44, it could alternatively be attached solely to the inner face of cross-rail 42, at or adjacent to its intersection with a side wall, or the bracket could be attached to both the cross-rail end and the adjacent front edge of the side face.

At or near the rear edge of each side panel/face a corner bracket 56 (again, preferably formed from folded sheet metal) is provided (see also FIG. 10), welded, riveted, screwed or otherwise fastened to both a side face 43, 44 and the rear face 41. Bracket 56 includes a recessed pocket located internally of the side and rear faces. The recessed pocket includes faces 57 and 58 meeting at a substantially right angle so that the pocket defines a substantially wedge-shaped volume on the inner side of the side face with bracket face 57 extending in a plane having a normal directed substantially directly at the peripheral edge bracket on the diagonally opposite side of the cabinet. A fastening coupler is formed in the rear ends of the restraints to attach each restraint to its respective corner bracket. Preferably, the fastening coupler comprises a threaded section about the end of the solid steel rod, the threaded end inserted into an aperture (not visible) in bracket face 57. The overall length of the diagonal restraint is arranged so that the rod terminates within the recessed pocket where a nut 59 of the coupler is wound onto the threaded rod end and may be tightened against bracket face 57 (or a washer between the nut and bracket face) to thereby adjust the tension in the diagonal restraint.

As an alternative to the tensioning adjustment mechanism just described, at least one of the diagonal restraints could include an end bracket that is fixed to an end of the diagonal restraint, within the foam. A tensioning adjustment mechanism could comprise a screw on the outer side of the rear or side cabinet face adjacent to the bracket. The screw could also pass through a threaded aperture in the bracket so that rotation of the screw changes the distance between the side or rear cabinet face and the bracket, thereby changing the tension in the diagonal restraint.

The preferred assembly order, prior to cabinet foaming, is to first attach the compartment liner(s) 49 and cross-rail 42, to the rear side of the throat assembly (not shown), then to install the diagonal restraints such that they extend in the space between the liners, then to attach the side panels 43/44, and then the rear panel 52. Accordingly, while the brackets 55, 56 and diagonal restraints 50, 51 should be installed to the cabinet internal surface prior to installation of the rear panel 52 to the assembly and the introduction of foam to the cavity between the cabinet faces and liner(s), adjustment of the tension in the diagonal restraints (and/or squaring of the cabinet's horizontal cross-section) may be achieved at any time post-foaming, even some years after manufacture of the insulated cabinet is completed. This tension tuning may be accomplished because, as may be seen in FIGS. 8A, 8B and 9, the side face 43, 44 is provided with an aperture 60 providing access from outside the cabinet to the wedge-shaped internal volume to thereby enable a tool, such as a socket of a socket wrench, to be inserted therein to rotate nut 59 while the restraint 50/51 is fixed against rotation about its longitudinal axis by pin 53 in its aperture.

Although FIGS. 8A and 9 show a "cross-brace" lateral stiffening arrangement comprising two crossed diagonal restraints, the required lateral stiffening at or near the cross-rail height could also be achieved by a single diagonal restraint. That is, either one of diagonal restraint 50 or 51 could be eliminated. The remaining single diagonal restraint would ideally be positioned to so that its forward end is attached to or adjacent to the side face to which the door's hinge plates are attached or adjacent to. The single diagonal restraint would resist the horizontal cross-section of the cabinet from "parallelogramming" by retraining that diagonal of the cabinet cross-section from extending in length. The lack of a diagonal restraint on the other diagonal of the cabinet cross-section, which diagonal would tend to decrease in length, may still result in an acceptable reduction in door droop. It should be appreciated that although the tensioning adjustment mechanisms described above are considered beneficial, it may not be essential as the diagonal restraints may not need tension adjustment post-foaming or alternative self-regulating tension adjustment mechanisms may be utilised. It should also be appreciated that the above-described tension adjustment mechanism could be provided at the front end of the diagonal restraints, at both front and rear ends of the restraints, on only one of the restraints, or at a first end on one restraint and on the opposite end of the other restraint.

As is clearly shown in FIGS. 8A and 8B, an inherently torsionally weak cabinet 41 may be provided with a torsionally stiff structure 62 fixed to or comprising one of its five closed faces to substantially increase torsional stiffness of the cabinet assembly beyond that of the cabinet alone so that the cabinet has an increased ability to resist twisting. Exemplary designs and the benefits of such a torsionally stiff structure have already been described and explained above in relation to the single door cabinet example and those details also apply to the presently-described multiple closure cabinet example. For example, the torsionally stiff structures illustrated and described with reference to any of FIG. 4A, 4B, 5A or 5B could be rigidly fixed to, or form a part of the bottom face 63 of cabinet 41. As previously mentioned, conveniently, torsionally stiff structure 62 could also act as a housing space for the compressor and other refrigeration system components.

Second Exemplary Embodiment of a Lateral Stiffening Arrangement

A second exemplary lateral stiffening arrangement to the diagonal restraint(s) described above will now be described with reference to FIGS. 11 to 13.

Many of the features of FIG. 11 have already been described with reference to FIG. 8A and so will not be explained again while commonly-illustrated features have been given the same reference numerals. The cabinet lateral stiffening arrangement in FIG. 11 comprises a portal frame (also referred to herein as an "internal perimeter frame" or simply "frame") 70. Preferably frame 70 is formed from a single sheet metal piece and could be folded or pressed, although it could also be formed from plural separate leg members that are attached together.

Frame 70 is preferably substantially horizontally arranged (substantially perpendicular to either/both of the side cabinet faces) and located within the cabinet at a vertical height that will be between the upper and lower compartments once an internal liner has been added to the cabinet in the space that will be foamed. Frame 70 is made up of a plurality of leg members 71, 72, 73 and 74 (see FIG. 12) that are assembled about a central opening 75 in the frame. The leg members are arranged in a closed geometrical shape, for example a rectangle, although other shapes such as oval, or polygonal shapes such as a hexagon or an octagon could also be suitable. Frame 70 spans between and is attached to at least the opposed cabinet side faces 43, 44, and preferably is also attached to the rear cabinet face 52.

In the illustrated, rectangular, embodiment the leg members are straight and the portal frame is dimensioned so that leg members 71, 72 and 73 are each in contact with the inner surface of a respective face (44, 53, 52) of the cabinet. The legs may be screwed, riveted, welded or otherwise fastened to their respective closed cabinet face. When frame 70 is substantially rectangular in shape, one leg member (74) spans across the open face of the cabinet and can serve the dual function of both a portal frame leg member and a cross-rail between the side faces providing, for example, a fastening location for a door lower hinge bracket. Although FIGS. 11 and 12 show leg member 74 offset rearwardly from the open face of the cabinet, the front face of leg member 74 could be nearer or even flush with the open face.

The portal frame 70 provides lateral stiffening to the cabinet assembly so that it is able to resist the aforementioned "parallelogramming" tendency in a horizontal cross-section through the cabinet. Resistance to this deformation is improved by increasing the stiffness of the corners (77-79) of the portal frame. This could be achieved by adding gusset members diagonally between the adjacent ends of adjacent leg members. The leg members (and optional gusset members) could be substantially flat, planar members (not as illustrated) having a lateral width and longitudinal length much greater than their thickness and all extending in a common plane. Rather than adding separate gusset members, the portal frame could be a unitary construction with integrated gusset members between adjacent leg members.

Figure 11:
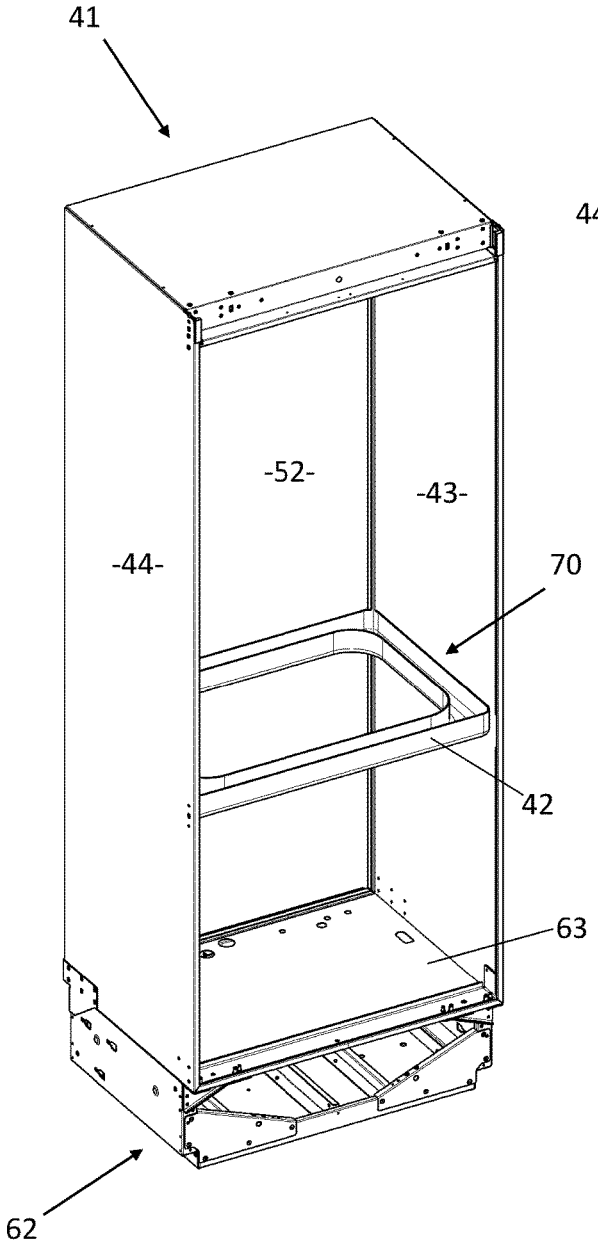
FIG. 11 is a perspective view from the front, one side and above of a multiple-closure refrigeration appliance assembly incorporating a second exemplary cabinet lateral stiffening arrangement.
Figure 12:
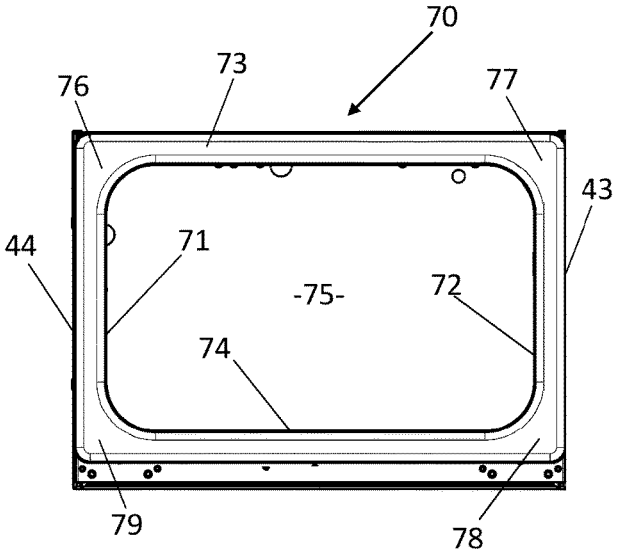
FIG. 12 is a horizontal cross-sectional detail view through the refrigeration appliance assembly of FIG. 11 at a height above the lateral stiffening arrangement, looking towards the bottom face of the cabinet.
Figure 13:
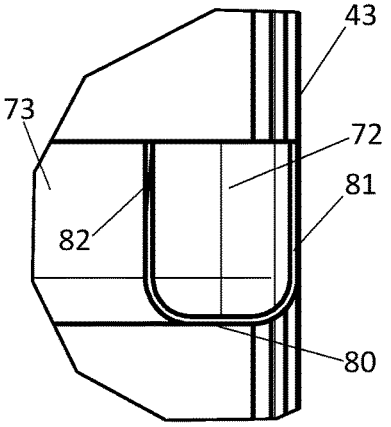
FIG. 13 is a vertical cross-sectional view through the cabinet lateral stiffening arrangement shown in FIG. 11.

Alternatively, as shown in FIGS. 11 and 12, the leg members could be channel-shaped members having a base 80 and two opposed side walls 81, 82. Ideally the channel leg member version of the portal frame is cut and formed form a single metal sheet and the leg member channel is continuous around the entire frame 70. In comparison to a planar leg member version, the channel leg member version of the portal frame offers an improved ability to resist the aforementioned "parallelogramming" tendency. In the channel leg member version illustrated, gusset members are formed in the unitary structure by increasing the width of the base 80 at corner regions 76-79. As can be seen most clearly in FIG. 12, the corners of the portal frame are "radiused" to achieve the aforementioned corner thickening.

It will be appreciated that the portal frame version of the lateral stiffening arrangement, by having a central opening positioned in the space between the upper and lower compartments and which is void of any reinforcing material, has little detrimental effect on heat flow so that heat is not conducted from the warm outside into the upper and lower cabinet compartments.

The combination of torsionally stiff structure 62 and the lateral stiffening arrangement including, for example, diagonal restraints 50, 51, improves the ability of a torsionally weak cabinet 41 to resist both torsional and lateral bending forces which would otherwise cause deformations of the cabinet that result in door droop. In fact, by holding the vertically central region of the cabinet stiff and avoiding/reducing the tendency for the "parallelogramming" shown in FIG. 7C, the lateral stiffening arrangement allows the torsional stiff structure to function correctly over the entire vertical height of the cabinet so that cabinet deflections are maintained within acceptable levels even in the case of a door hinged adjacent to an upper cabinet compartment. It should be appreciated though that incorporation of a lateral stiffening arrangement on its own, such as the "cross-brace" formed by diagonal restraints 50, 51 (or only one of diagonal restraints 50, 51) and their/its associated mounting/fastening bracket(s), without the additional incorporation of a torsionally stiff structure 62 such as illustrated in FIG. 4A, 4B, 5A or 5B, will reduce door droop. Accordingly, the incorporation of the torsionally stiff structure should not be seen as essential, particularly in cabinets that are not subject to significant twisting forces.

Third Exemplary Embodiment of a Lateral Stiffening Arrangement

A third exemplary lateral stiffening arrangement will now be described with reference to FIGS. 14 to 16. Many of the features of this embodiment have already been described with reference to the previous two exemplary embodiments. Accordingly, those previously-described common features that are clearly compatible with this embodiment will not be explained again, and any commonly-illustrated features have been given consistent reference numerals.

Figure 10:
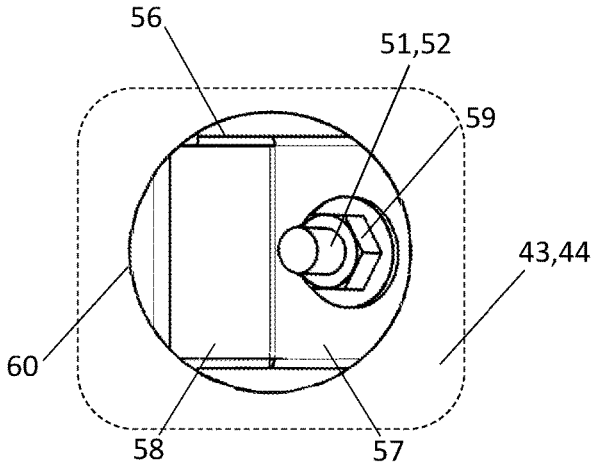
FIG. 10 is a close-up view of detail 'A' in FIG. 8B showing a tightening/tensioning coupling mechanism at an end of the stiffening apparatus.

It can be seen in FIG. 14 that the lateral stiffening arrangement is similar to the first exemplary embodiment illustrated and described with reference to FIGS. 8 to 10 with diagonal restraints, such as solid or hollow, circular cross-section steel rods, 50 and 51 spanning the cabinet diagonally in a substantially horizontal plane and located in the volume between the vertically-spaced internal liners 49. Whereas the FIG. 8 embodiment included apertures 60 at the rear side of each side panel 34/44 to enable access to the rear ends of the diagonal restraints 50/51, the FIG. 14 embodiment has no such apertures in the side panels. Instead, apertures 60 (not visible in FIG. 14 but see FIG. 15) are provided at either side of rear panel 52. As with the FIG. 8 embodiment, apertures 60 in this embodiment each provide access to a substantially wedge-shaped void or volume within cabinet 41, on the inner side of the rear panel. This void or volume lacks any insulating foam.

Figure 15:
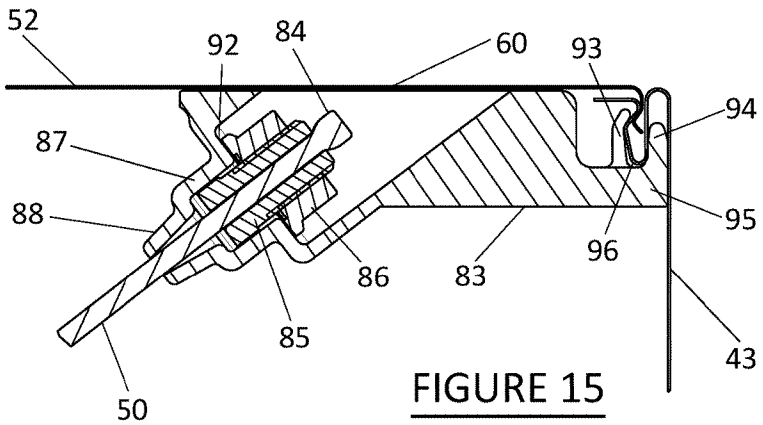
FIG. 15 is an enlarged horizontal cross-sectional view through a rear corner part of the refrigeration appliance assembly of FIG. 14.

As shown more clearly in FIG. 15, the wedge-shaped volume is formed as a recess within a rear bracket 83 to which the rear end of a diagonal restraint 50/51 is attached/fastened. Although FIG. 14 illustrates only a single rear bracket 83 on the right-hand-side of the cabinet attached to diagonal restraint 50, an additional rear bracket 83 is not visible in the drawing but is attached to the rear end of diagonal restraint 51. Rear brackets 83 may be formed from sheet metal such as sheet steel folded and welded, or they could alternatively be formed from cast metal such as Aluminium or Zinc alloy. As most clearly shown in FIG. 14, bracket 83 includes a planar face in contact with rear panel 83. It can be seen in FIG. 15 that bracket 83 is coupled, fixed or attached to cabinet 41 at or adjacent to the line of intersection of a side panel and the rear panel. That is, brackets 83 each connect to cabinet 41 at or adjacent to, or in the region of, a side edge of the rear of the cabinet. Brackets 83 could, alternatively, be connected only to rear regions of the side panels of the cabinet.

Figure 14:
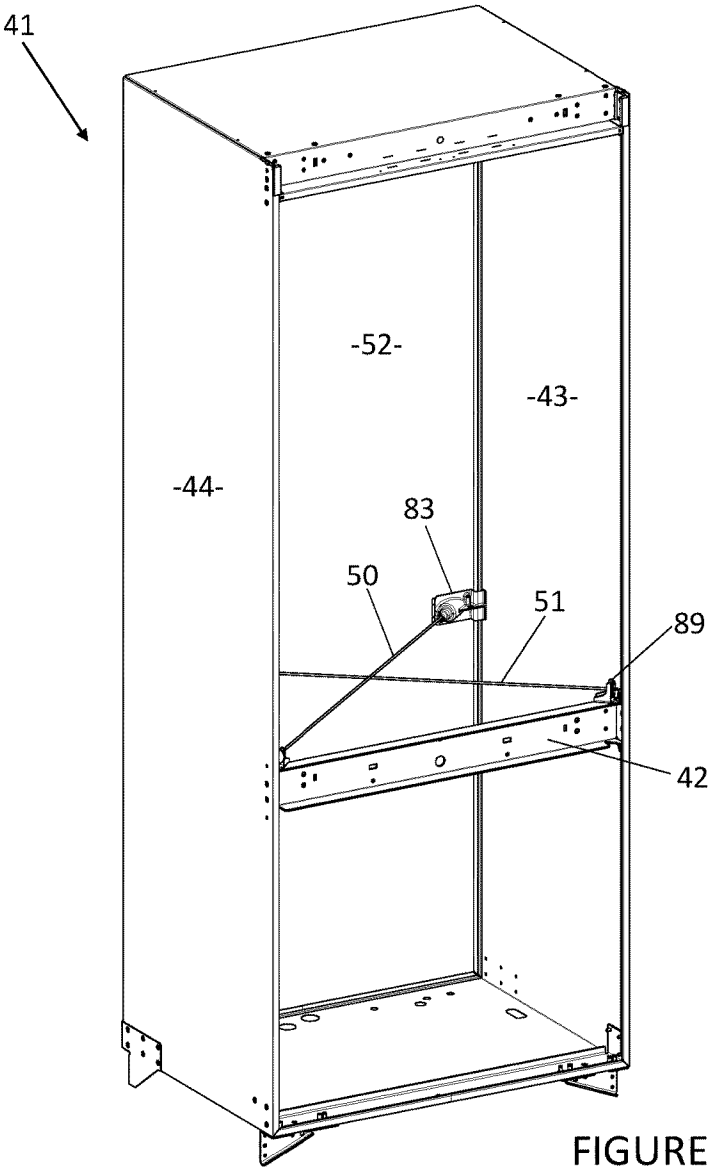
FIG. 14 is a perspective view from the front, one side and above of a multiple-closure refrigeration appliance assembly incorporating a third exemplary cabinet lateral stiffening arrangement, without its torsionally stiff base structure.

FIGS. 14 and 15 show an exemplary arrangement for coupling bracket 83 to the cabinet by clipping teeth/fingers 93 and 94, formed at a lateral end 95 of bracket 83, about a longitudinal rib 96 formed in an edge "S-fold" of side panel 43 (the longitudinal slot on the inside of rib 96 receiving an edge fold of rear panel 52). This arrangement has the added benefit, during appliance assembly, of allowing brackets 83 to be attached to side panel 43 and held in the correct position thereby, prior to rear panel 52 being installed. Though not clearly shown in FIG. 14 or FIG. 15, brackets 83 may be secured to rear panel 52 by means of screws passing through the rear panel and into the rear side of the planar face of bracket 83. The strength of the coupling between bracket 83 and cabinet 41 is further improved once the void between liner(s) and cabinet wrapper have been filled with solidified insulating foam.

The wedge-shaped recess in each rear bracket 83 includes a face 92 extending in a plane that is substantially perpendicular to the longitudinal extent of its diagonal restraint 50/51. Face 92 has an opening which allows diagonal restraint 50/51 to pass therethrough. The diagonal restraint 50, and the opening therefor, extends substantially perpendicularly to the plane of face 92. The opening in face 92 is surrounded by a first wall 87 and, further towards the centre of the cabinet, by a second wall 88. First wall 87 defines a first volume surrounding the longitudinal axis of the diagonal restraint and preferably has a substantially constant cross-section along that axis. Preferably the cross-section of the volume bounded by wall 87 has a non-circular cross-section. Second wall 88 is tapered so that it bounds a substantially frusto-conical second volume having a larger first diameter adjacent the first volume and a smaller second diameter further towards the centre of the cabinet. The smaller, second diameter of the second volume bounded by second wall 88 is adapted to be a tight fit, such as a sliding clearance fit, around the diagonal restraint to enable the diagonal restraint to pass through the opening. The tight fit also forms a seal between the restraint and the bracket to avoid or restrict insulating foam from entering the first and second volumes. For a nominally 4 mm diameter rod forming the diagonal restraint, the smallest opening formed by wall 88 would therefore be slightly greater than 4 mm.

Because the restricted opening to the bracket which surrounds the diagonal restraint may not form a perfect seal, foam may still enter the second volume of the bracket, bounded by wall 88. However, the axial length of the second volume is sufficient to ensure that any foam entering the second volume will stall out (that is, begin to set and therefore stop expanding/moving) before it reaches the first volume. For example, in the present embodiment, with a tight fit around a diagonal restraint rod of 4 mm diameter, the axial length of the second volume may be between around 10 mm to around 15 mm, most preferably around 12 mm.

It can also be seen in FIG. 15 that the rear end 84 of diagonal restraint 50 is flared out, preferably as a result of being flattened, such as by a press. Unlike the embodiment of FIG. 8, in this embodiment the diagonal restraint 50 is not threaded near its rear end 84. Instead, an externally-threaded boss 85 has a central opening through which the diagonal restraint is passed, the flared end 84 retaining boss 85 on the diagonal restraint. A forward end of boss 85 is received within the first volume bounded by first bracket wall 87. At least a forward portion of the forward end of boss 85 is non-circular in cross-section (perpendicular to the axis of its opening) and has a shape that is complementary to the cross-sectional shape of the first volume. For example, the first volume and the forward portion of the forward end of boss 85 may both have square or hexagonal cross-sections. In this way, boss 85 is non-rotatable within the first volume.

An internally-threaded nut 86 is wound onto the outer surface of boss 85 with the threads of the two components engaging. Boss 85 and nut 86 combine to form a stopper on end 84 of the diagonal restraint. Tightening nut 86 moves the nut along the axial length of boss 85 toward its forward end until the forward face of the nut engages bracket face 92. At this point, further tightening of nut 86 moves boss 85 (which is unable to rotate) axially rearwardly, towards panel 52 until the rearward end of boss 85 engages the flared end 84 of the diagonal restraint. At this point, because the front end 90 (see FIG. 16) of the diagonal restraint is fixed relative to the cabinet (as will be explained below), further tightening of nut 86 increases the tension in the diagonal restraint. Conversely, turning nut 86 in the opposite rotational direction will release tension in the diagonal restraint. It will be appreciated that apertures 60 in rear panel 52 enable access to nut 86 from outside the cabinet so that appropriate adjustment to the tension in diagonal restraints 50 and 51 may be made following manufacture of the refrigeration appliance 1. It will also be appreciated that brackets 83, in conjunction with boss 85, nut 86 and flared end 84 act as couplers, coupling the rear ends of the diagonal restraints to a rear corner region of the cabinet.

Figure 16:
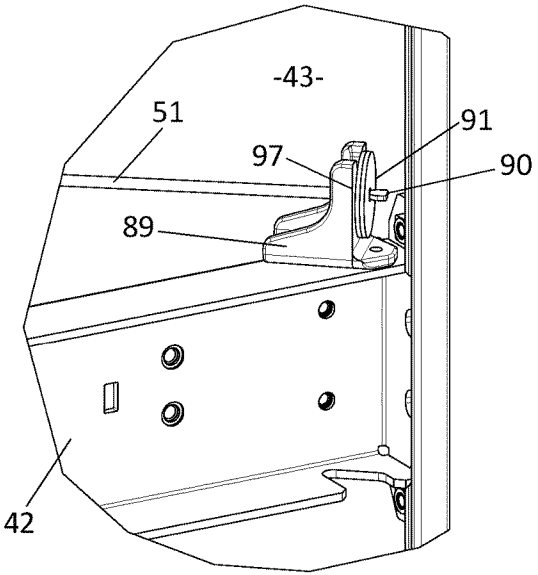
FIG. 16 is an enlarged detail view of the front right-hand-side termination of the cabinet lateral stiffening arrangement of FIG. 14.

As shown in FIG. 16, the forward end 90 of diagonal restraint 51 (and also of restraint 50, although not shown) is coupled to the cabinet at or adjacent to the vertical front edge of the side panel 43/44. In the exemplary arrangement shown in this embodiment a cross-rail 42 spans the open front of the cabinet between side walls 43 and 44, at a vertical height between spaces that will become upper and lower compartments 45 and 46 (see FIG. 7B). In this exemplary embodiment, the forward end of the diagonal restraint 50/51 is coupled to the cabinet via a forward bracket 89 fastened (such as by riveting or bolting) to an upper face of cross-rail 42 at or near or in the region of the cross-rail's lateral ends (that is, adjacent to where the cross-rail is fastened to a side wall). Alternatively, bracket 89 could be formed as an integral part of a monolithic cross-rail 42. As with the rear ends 84, forward ends 90 of the diagonal restraints are flared out, preferably as a result of being flattened, such as by a press. The diagonal restraints may therefore have a circular cross-section over the majority of their length, but not their ends. One or more stoppers such as washers 91 are retained on each diagonal restraint by the flared end 90. Forward bracket 89 has a flat front face 97 that is bifurcated, having two vertically extending legs separated by a central, vertically-aligned slot in which the diagonal restraint is received, with the washer(s) 91 seated against flat face 97. It will be appreciated that washers 91, in conjunction with the flared end 90 of the diagonal restraint, act as couplers, coupling the forward end of the diagonal restraint to a lateral end region of the cross-rail 42, and therefore to a forward edge region of the cabinet.

As explained above, tightening of nut 86 draws the diagonal restraint through the opening in bracket 83, and at the same time ensures that the washer(s) 91 are forced against flat front face 97 by the flared end 90. In the case of a single fastening between bracket 89 and cross-rail 42, the bracket may have some ability to pivot about that, preferably vertically-aligned fastening, so that flat face 97 may remain substantially perpendicular to the axis of its diagonal restraint. In the case of bracket 89 forming a part of the cross-rail, front face 97 may be other than flat, such as curved, or a faceted arc.

The foregoing description of the invention includes preferred forms thereof. Modifications may be made thereto without departing from the scope of the invention as defined by the accompanying claims.

The invention claimed is:

1. A refrigeration appliance assembly comprising:

a cabinet comprising five closed faces and an open face providing access to an interior of the cabinet, the five closed faces including opposing first and second side faces and a rear face, opposite to the open face, connecting the side faces together, a partitioning member spanning the open face and connecting the first and second side faces of the cabinet together, the partitioning member dividing the open face into upper and lower open regions, an internal liner or liners within the interior of the cabinet forming upper and lower cooling compartments, divided by the partitioning member, a torsionally stiff structure comprising a box or cuboid structure fixed to or comprising one of the five closed faces to substantially increase torsional stiffness of the assembly beyond that of the cabinet alone so that the cabinet has an increased ability to resist twisting, and at least one diagonal restraint spanning diagonally across the cabinet from or adjacent to the first side face to, or adjacent to, the second side face, the at least one diagonal restraint extending in a space between the upper and lower cooling compartments, wherein the at least one diagonal restraint is substantially straight with opposing ends, each said end having a coupler formed therein and/or attached thereto for connection to at least one said closed face and/or the partitioning member, and wherein one of the couplers comprises a bracket on the cabinet or the partitioning member, one said diagonal restraint passing through a surface of the bracket facing an end of the diagonal restraint, the surface of the bracket engageable with a stopper on the diagonal restraint, the stopper movable along, but constrained from moving past, an end of the diagonal restraint.

2. The refrigeration appliance assembly as claimed in claim 1, wherein the at least one diagonal restraint includes first and second diagonal restraints, the first and second diagonal restraints arranged in a cross formation.

3. The refrigeration appliance assembly as claimed in claim 1, wherein the at least one diagonal restraint is in a substantially horizontal plane.

4. The refrigeration appliance assembly as claimed in claim 1, wherein the first and second side faces have a front edge region adjacent the open face and lateral end regions of the partitioning member, and an intersection between each said side face and the rear face comprises a rear corner region, wherein each said diagonal restraint extends from the front edge region of one of the first or second side faces to the rear corner region of another of the first or second side faces.

5. The refrigeration appliance assembly as claimed in claim 1, wherein the at least one diagonal restraint is both fixed to a side region of the rear face and to one said side face.

6. The refrigeration appliance assembly as claimed in claim 1, wherein the at least one diagonal restraint comprises either a solid rod or a hollow tube, and has a circular cross-section along at least a majority of a length thereof.

7. The refrigeration appliance assembly as claimed in claim 1, wherein a connection between at least one of the couplers and an adjacent said closed face or the partitioning member is adjustable to alter tension in one said diagonal restraint, the connection accessible from outside the cabinet.

8. The refrigeration appliance assembly as claimed in claim 7, wherein a void between the cabinet's closed faces and the liner or liners, and said space between the upper and lower cooling compartments, is filled with insulating foam, and wherein one of the couplers comprises a bracket on the cabinet or the partitioning member.

9. The refrigeration appliance assembly as claimed in claim 8, wherein the connection is accessible from outside the cabinet via an opening in one said closed face, the bracket substantially blocking egress of the insulating foam via said opening.

10. The refrigeration appliance assembly as claimed in claim 1, wherein the stopper comprises an externally-threaded boss about the diagonal restraint and an internally-threaded nut about the boss, wherein the boss is non-rotationally coupled to the bracket.

11. The refrigeration appliance assembly as claimed in claim 1, wherein one of the couplers comprises a flattened region with a pin protruding therefrom or therethrough, one said side face of the cabinet and/or an inner face of the partitioning member adjacent said cabinet side face is provided with a flattened tab protruding therefrom into the interior of the cabinet, the flattened tab being in a substantially horizontal plane and having an aperture formed therein, the pin of the coupler passing through the aperture in the flattened region so that the at least one diagonal restraint is pivotally connected to the side face and/or the partitioning member.

12. The refrigeration appliance assembly as claimed in claim 1, wherein one of the couplers comprises a threaded shaft and a threaded nut, at least one said side face and the rear face of the cabinet is provided with a bracket having a face located within the interior of the cabinet and adjacent to the side and/or rear face of the cabinet, with an aperture therein aligned to receive the threaded shaft therethrough, the threaded nut wound onto the threaded shaft and adapted to engage the face.

13. The refrigeration appliance assembly as claimed in claim 1, wherein the torsionally stiff structure is fixed to or comprises a bottom face or a top face of the cabinet.

14. The refrigeration appliance assembly as claimed in claim 1, wherein the torsionally stiff structure forms a plinth below the cabinet.

15. The refrigeration appliance assembly as claimed in claim 1, wherein the five closed faces of the cabinet comprise sheet metal.

16. The refrigeration appliance assembly as claimed in claim 1, wherein a void between the cabinet's closed faces and the liner or liners, and said space between the upper and lower cooling compartments, is filled with insulating foam.

17. A refrigeration appliance including the refrigeration appliance assembly as claimed in claim 1, and further comprising separate closures mounted to the cabinet, each said closure for closing the upper or lower cooling compartment.

18. The refrigeration appliance assembly as claimed in claim 1, wherein the torsionally stiff structure comprises a rectangular cuboid, a square cuboid or a rectangular prism.

19. The refrigeration appliance assembly as claimed in claim 1, wherein the torsionally stiff structure has six main sides, one or more of which is at least partially open.

20. The refrigeration appliance assembly as claimed in claim 1, wherein the torsionally stiff structure comprises a sheet metal box.

21. The refrigeration appliance assembly as claimed in claim 1, wherein the torsionally stiff structure comprises a sheet metal box having at least one open side and the sheet metal box is fixed to the cabinet so that an open side of the box is closed by a closed face of the cabinet, the closed face of the cabinet and the sheet metal box forming the torsionally stiff structure.

22. A refrigeration appliance assembly comprising:

a cabinet comprising five closed faces and an open face providing access to an interior of the cabinet, the five closed faces including opposing first and second side faces and a rear face, opposite to the open face, connecting the side faces together, a partitioning member spanning the open face and connecting the first and second side faces of the cabinet together, the partitioning member dividing the open face into upper and lower open regions, an internal liner or liners within the interior of the cabinet forming upper and lower cooling compartments, divided by the partitioning member, and at least one diagonal restraint spanning diagonally across the cabinet from or adjacent to the first side face to, or adjacent to, the second side face, the at least one diagonal restraint extending in a space between the upper and lower cooling compartments, wherein the at least one diagonal restraint is substantially straight with opposing ends, each said end having a coupler formed therein and/or attached thereto for connection to at least one said closed face and/or the partitioning member, and wherein one of the couplers comprises a flattened region with a pin protruding therefrom or therethrough, one said side face of the cabinet and/or an inner face of the partitioning member adjacent said cabinet side face is provided with a flattened tab protruding therefrom into the interior of the cabinet, the flattened tab being in a substantially horizontal plane and having an aperture formed therein, the pin of the coupler passing through the aperture in the flattened region so that the at least one diagonal restraint is pivotally connected to the side face and/or the partitioning member.

23. A refrigeration appliance assembly comprising:

a cabinet comprising five closed faces and an open face providing access to an interior of the cabinet, the five closed faces including opposing first and second side faces and a rear face, opposite to the open face, connecting the side faces together, a partitioning member spanning the open face and connecting the first and second side faces of the cabinet together, the partitioning member dividing the open face into upper and lower open regions, an internal liner or liners within the interior of the cabinet forming upper and lower cooling compartments, divided by the partitioning member, and at least one diagonal restraint spanning diagonally across the cabinet from or adjacent to the first side face to, or adjacent to, the second side face, the at least one diagonal restraint extending in a space between the upper and lower cooling compartments, wherein the at least one diagonal restraint is substantially straight with opposing ends, each said end having a coupler formed therein and/or attached thereto for connection to at least one said closed face and/or the partitioning member, and wherein one of the couplers comprises a bracket on the cabinet or the partitioning member, one said diagonal restraint passing through a surface of the bracket facing an end of the diagonal restraint, the surface of the bracket engageable with a stopper on the diagonal restraint, the stopper movable along, but constrained from moving past, an end of the diagonal restraint.

24. The refrigeration appliance assembly as claimed in claim 23, wherein a connection between at least one of the couplers and an adjacent said closed face or the partitioning member is adjustable to alter tension in one said diagonal restraint, the connection accessible from outside the cabinet.

25. The refrigeration appliance assembly as claimed in claim 23, wherein the stopper comprises an externally-threaded boss about the diagonal restraint and an internally-threaded nut about the boss, wherein the boss is non-rotationally coupled to the bracket.

* * * * *